United States Patent [19]

Le et al.

[11] Patent Number: 4,753,722

[45] Date of Patent: Jun. 28, 1988

[54] TREATMENT OF MERCAPTAN-CONTAINING STREAMS UTILIZING NITROGEN BASED PROMOTERS

[75] Inventors: Binh N. Le, Humble; Gilbert D. Veasey, Dickinson, both of Tex.

[73] Assignee: Merichem Company, Houston, Tex.

[21] Appl. No.: 875,339

[22] Filed: Jun. 17, 1986

[51] Int. Cl.[4] ..... C10G 29/00

[52] U.S. Cl. ..... 208/207; 208/236; 502/163; 210/758

[58] Field of Search ..... 208/207, 236; 502/163; 210/758

[56] References Cited

U.S. PATENT DOCUMENTS

| | | | |
|---|---|---|---|
| 2,176,806 | 10/1939 | Schuessler et al. | 23/270 |
| 2,215,359 | 9/1946 | Livingston et al. | 196/13 |
| 2,299,426 | 10/1942 | Rosebaugh | 23/310 |
| 2,425,414 | 8/1947 | Bond | 23/184 |
| 2,508,817 | 5/1950 | Devol et al. | 196/29 |
| 2,565,349 | 8/1951 | Browder | 196/29 |
| 2,606,099 | 8/1952 | Happel et al. | 23/184 |
| 2,662,001 | 12/1953 | Burns et al. | 23/270.5 |
| 2,671,048 | 3/1954 | Rosenwald | 208/207 |
| 2,674,566 | 4/1954 | Ooslerhont et al. | 208/207 |
| 2,723,944 | 11/1955 | Chenicek | 208/207 |
| 2,740,749 | 4/1956 | Meguerian et al. | 196/32 |
| 2,853,432 | 9/1958 | Gleim et al. | 196/32 |
| 2,859,177 | 11/1958 | Rippie et al. | 210/758 |
| 2,906,706 | 9/1959 | King | 208/231 |
| 2,921,021 | 1/1960 | Urban et al. | 208/205 |
| 2,937,986 | 5/1960 | Lukk | 208/88 |
| 2,988,500 | 6/1961 | Gleim et al. | 208/206 |
| 3,098,033 | 7/1963 | Weisang et al. | 208/235 |
| 3,107,213 | 10/1963 | Cole et al. | 208/235 |
| 3,108,081 | 10/1963 | Gleim et al. | 252/428 |
| 3,205,164 | 9/1965 | Brown | 208/236 |
| 3,226,092 | 12/1965 | Graham et al. | 259/2 |
| 3,238,124 | 3/1966 | Burton | 210/3 |
| 3,258,421 | 6/1966 | Grutsch | 208/236 |
| 3,351,434 | 11/1967 | Grimes et al. | 23/310 |
| 3,371,031 | 2/1968 | Strong | 208/207 |
| 3,408,287 | 10/1968 | Urban et al. | 208/207 |
| 3,409,543 | 11/1968 | Urban et al. | 208/234 |
| 3,413,215 | 11/1968 | Beshears | 208/206 |
| 3,445,380 | 5/1969 | Urban | 208/206 |
| 3,449,239 | 6/1969 | Moore | 208/198 |
| 3,471,254 | 10/1969 | Urban | 23/114 |
| 3,496,996 | 2/1970 | Osdor | 165/111 |
| 3,515,677 | 6/1970 | Pothowicz | 252/430 |
| 3,565,959 | 2/1971 | Takase et al. | 208/207 |
| 3,574,093 | 4/1971 | Strong | 208/206 |
| 3,585,005 | 6/1971 | Coggar | 23/267 |
| 3,758,404 | 9/1973 | Clonts | 208/263 |
| 3,785,964 | 1/1974 | Chun et al. | 208/191 |
| 3,839,487 | 10/1974 | Clonts | 260/683.48 |
| 3,853,746 | 12/1974 | Gattuso | 208/207 |
| 3,923,645 | 12/1975 | Anderson, Jr. et al. | 208/206 |
| 3,931,054 | 6/1976 | Lester | 252/460 |
| 3,972,829 | 8/1976 | Michalko | 252/466 |
| 3,977,829 | 8/1976 | Clonts | 23/267 |
| 3,989,466 | 11/1976 | Pan | 23/267 |
| 3,992,156 | 11/1976 | Clonts | 23/267 |
| 3,998,759 | 12/1976 | Hoekstra | 252/466 |
| 4,003,827 | 1/1977 | Carlson et al. | 208/206 |
| 4,009,120 | 2/1977 | Hillman | 208/206 |
| 4,018,705 | 4/1977 | Carlson et al. | 252/411 |
| 4,019,869 | 4/1977 | Morris | 23/288 |
| 4,033,860 | 7/1977 | Carlson | 208/182 |

(List continued on next page.)

FOREIGN PATENT DOCUMENTS

| | | | |
|---|---|---|---|
| 2773 | 2/1965 | Japan | 208/207 |

*Primary Examiner*—Helen M. S. Sneed
*Assistant Examiner*—Helane Myers
*Attorney, Agent, or Firm*—Baker, Kirk & Bissex

[57] ABSTRACT

An improved method of treating streams having mercaptan or mercaptan-based compounds therein particularly adapted for the processes of sweetening sour hydrocarbons and regenerating spent caustic solutions is described. The invention comprises contacting a first stream having the mercaptan or mercaptan-based compounds therein with a second stream in the presence of effective amounts of a nitrogen-based promoter to promote the extraction and/or the catalytic oxidation of the mercaptan compounds therein. The invention herein disclosed and described is applicable in a wide variety of apparatus and processes adapted for sweetening and regeneration operations.

50 Claims, 3 Drawing Sheets

U.S. PATENT DOCUMENT

| | | | |
|---|---|---|---|
| 4,039,389 | 8/1977 | Christman | 196/14.52 |
| 4,039,586 | 8/1977 | Skasha et al. | 260/608 |
| 4,040,947 | 8/1977 | Christman | 208/234 |
| 4,048,097 | 9/1977 | Douglas | 252/431 |
| 4,070,271 | 1/1978 | Carlson et al. | 208/206 |
| 4,078,992 | 3/1978 | Douglas | 208/206 |
| 4,081,354 | 3/1978 | Christman | 208/230 |
| 4,087,378 | 5/1978 | Carlson | 252/431 |
| 4,088,569 | 5/1978 | Douglas | 208/206 |
| 4,090,954 | 5/1978 | Ward | 208/206 |
| 4,098,681 | 7/1978 | Carlson | 208/206 |
| 4,100,057 | 7/1978 | Carlson et al. | 208/206 |
| 4,104,155 | 8/1978 | Christman | 208/234 |
| 4,107,078 | 8/1978 | Carlson | 252/431 |
| 4,113,604 | 9/1978 | Carlson | 208/192 |
| 4,113,604 | 9/1978 | Carlson | 208/192 |
| 4,121,988 | 10/1978 | Frame | 208/206 |
| 4,121,997 | 10/1978 | Frame | 208/206 |
| 4,121,997 | 10/1978 | Frame | 208/206 |
| 4,121,999 | 10/1978 | Carlson | 208/206 |
| 4,124,493 | 11/1978 | Frame | 208/206 |
| 4,124,494 | 11/1978 | Frame | 208/207 |
| 4,124,531 | 11/1978 | Frame | 252/428 |
| 4,127,474 | 11/1978 | Frame | 208/206 |
| 4,141,819 | 2/1979 | Carlson | 208/206 |
| 4,142,964 | 3/1979 | Carlson et al. | 208/206 |
| 4,156,641 | 5/1979 | Frame | 208/206 |
| 4,157,312 | 6/1979 | Frame | 252/428 |
| 4,159,964 | 7/1979 | Frame | 252/428 |
| 4,168,245 | 9/1979 | Carlson et al. | 252/431 |
| 4,199,440 | 4/1980 | Verachtert | 203/263 |
| 4,201,626 | 5/1980 | Asdigian | 422/256 |
| 4,203,827 | 5/1980 | Frame | 208/206 |
| 4,206,043 | 6/1980 | Carlson | 208/207 |
| 4,206,079 | 6/1980 | Frame | 252/428 |
| 4,207,173 | 6/1980 | Stansky, Jr. | 208/206 |
| 4,213,877 | 7/1980 | Frame | 252/412 |
| 4,219,420 | 8/1980 | Muller | 210/65 |
| 4,248,694 | 2/1981 | Carlson et al. | 208/206 |
| 4,250,022 | 2/1981 | Frame | 208/206 |
| 4,260,479 | 4/1981 | Frame | 208/206 |
| 4,276,194 | 6/1981 | Carlson | 252/428 |
| 4,290,913 | 9/1981 | Frame | 252/428 |
| 4,290,916 | 9/1981 | Carlson | 252/430 |
| 4,290,917 | 9/1981 | Carlson | 252/428 |
| 4,293,442 | 10/1981 | Frame | 252/428 |
| 4,295,993 | 10/1981 | Carlson | 252/430 |
| 4,298,463 | 11/1981 | Frame | 208/206 |
| 4,298,502 | 11/1981 | Carlson | 252/431 |
| 4,299,729 | 11/1981 | Frame | 252/412 |
| 4,308,169 | 12/1981 | Frame | 252/412 |
| 4,324,650 | 4/1982 | Carlson | 208/189 |
| 4,337,147 | 6/1982 | Frame | 208/206 |
| 4,347,226 | 8/1982 | Audeh et al. | 208/235 |
| 4,354,926 | 10/1982 | Carlson | 208/206 |
| 4,360,421 | 11/1982 | Frame | 208/206 |
| 4,362,614 | 12/1982 | Asdigian | 208/235 |
| 4,364,821 | 12/1982 | O'Brien | 208/322 |
| 4,364,843 | 12/1982 | Carlson | 252/428 |
| 4,374,042 | 2/1983 | Frame | 252/412 |
| 4,378,305 | 3/1983 | Carlson | 252/431 |
| 4,404,098 | 9/1983 | Asdigian | 208/230 |
| 4,411,776 | 10/1983 | Carlson | 208/206 |
| 4,412,912 | 11/1983 | Asdigian | 208/206 |
| 4,412,913 | 11/1983 | Moote et al. | 208/207 |
| 4,417,986 | 11/1983 | Connaught et al. | 208/235 |
| 4,481,106 | 11/1984 | Verachtert | 208/206 |
| 4,481,107 | 11/1984 | Urban | 208/206 |
| 4,490,246 | 12/1984 | Verachtert | 208/193 |
| 4,491,565 | 1/1985 | Verachtert | 422/256 |
| 4,498,977 | 2/1985 | Frame | 208/189 |
| 4,498,978 | 2/1985 | Frame | 208/207 |
| 4,502,949 | 3/1985 | Frame | 208/189 |
| 4,514,286 | 4/1985 | Wang et al. | 208/196 |
| 4,562,300 | 12/1985 | LaFoy | 208/235 |
| 4,574,121 | 3/1986 | Frame | 208/207 |
| 4,594,147 | 6/1986 | Roy et al. | 208/207 |
| 4,666,689 | 5/1987 | Mapel et al. | 208/235 |

TREATMENT OF MERCAPTAN-CONTAINING STREAMS UTILIZING NITROGEN BASED PROMOTERS

BACKGROUND OF THE INVENTION

The present invention relates to the treatment of streams having mercaptan or mercaptan-based compounds therein; more particularly, it relates to improved methods for treating such streams by utilizing nitrogen-based promoters as additives to promote the extraction and/or catalytic oxidation of the mercaptan or mercaptan-based compounds therein.

This invention is particularly adapted to a variety of processes for sweetening mercaptan-containing sour hydrocarbon distillate, and is further adapted to the processes for regenerating spent caustic solutions utilized in extracting mercaptan compounds from such sour hydrocarbon distillate.

The art relating to the treatment of mercaptan-containing sour hydrocarbon distillate and the regeneration of spent caustic solutions is well developed and the processes and apparatus therefor are the subject of many patents. For example, U.S. Pat. Nos. 2,988,500; 3,371,031; 3,413,215; 3,445,380; 3,515,677; 3,574,093; 3,923,645; 3,931,054; 3,972,829; 4,003,827; 4,009,120; 4,018,705; 4,033,860; 4,070,271; 4,087,378; 4,090,954; 4,098,681; 4,107,078; 4,113,604; 4,121,998; 4,121,999; 4,124,531; 4,141,819; 4,206,043; 4,248,694; 4,298,502; 4,364,843; 4,481,106; 4,481,107; 4,490,246; 4,498,977; 4,498,978; and 4,579,121 are representative of catalytic oxidation processes and catalysts for treating mercaptan-containing sour hydrocarbon distillate. U.S. Pat. Nos. 2,425,414; 2,606,099; 2,740,749; 2,853,432; 2,921,021; 2,937,986; 3,107,213; 4,040,947; 4,081,354; 4,104,155; 4,199,440; and 4,362,614 are representative of extraction and regeneration processes. U.S. Pat. Nos. 2,176,806; 2,215,359; 2,299,426; 2,662,001; 3,226,092; 3,238,124; 3,351,434; 3,496,996; 3,585,005; 3,758,404; 3,839,487; 3,977,829; 3,989,466; 3,992,156; 4,019,869; 4,039,389; 4,201,626; 4,219,420; 4,364,821; and 4,491,565 are representative of apparatus useful in the practice of various of the aforementioned processes. All of the above-listed patents are hereby incorporated by reference herein for all purposes as if fully set forth.

In general, the sweetening of mercaptan-containing hydrocarbon distillate entails oxidizing the noxious mercaptan compounds to less objectionable disulfides. Commonly used treating processes provide for contacting the distillates with an oxidizing agent, usually air, and a mercaptan oxidation catalyst dispersed in an aqueous caustic solution, usually an alkali metal hydroxide solution. The sour distillate and the catalyst containing aqueous caustic solution provide a liquid-liquid system wherein mercaptans are converted to disulfides in the presence of an oxidizing agent, usually an oxygen containing gas dissolved in the hydrocarbon being treated.

Sour hydrocarbon distillate containing more difficultly oxidizable mercaptans may also be effectively treated in contact with a mercaptan oxidation catalyst deposited on a high surface area adsorptive support, usually a metal phthalocyanine on an activated charcoal. The distillate is treated in contact with the supported catalyst at oxidation conditions in the presence of an aqueous caustic solution. The oxidizing agent is most often air admixed with the distillate to be treated, and the caustic solution is most often aqueous alkali metal hydroxide. The caustic solution is charged continuously to the process or intermittently as required to maintain the catalyst in a caustic-wetted state.

Mercaptan-containing hydrocarbon distillate may also be sweetened by contacting the distillate with an aqueous caustic stream whereby the mercaptans are extracted into the caustic in the form of mercaptides. The mercaptide-containing caustic solution is then separated from the sweetened distillate and may be recycled until the caustic solution becomes spent, that is, until the caustic solution loses its capacity to extract the mercaptan compounds to such an extent that the process can no longer run efficiently.

Conventionally this spent caustic solution is either discarded or regenerated for reuse. In general, the regeneration of spent caustic solutions entails oxidizing the mercaptides to disulfides and extracting or otherwise separating out the resulting disulfides from the caustic solution. Commonly used regeneration processes provide for adding a mercaptan oxidation catalyst to the spent caustic solution then contacting the resulting solution with an oxidizing agent. The mercaptan oxidation catalyst is usually a metal phthalocyanine and the oxidizing agent is usually an oxygen-containing gas such as air. The catalyst containing caustic stream and the oxygen-containing gas provide a gas-liquid system wherein mercaptides are converted to disulfides in the presence of the gas, with the resulting disulfides being removed by the settling out thereof. The regenerated caustic stream is then separated from the settled residue for reuse.

The prior art, to a certain extent, recognizes that some nitrogen compounds may be useful in the sweetening and regeneration processes. For example, U.S. Pat. No. 2,508,817 recognizes the use of N-alkyl derivatives of paraphenylene diamine as catalysts in the oxidation of mercaptans to disulfides. More specifically, the patent teaches a batch process in which a light hydrocarbon oil suitable for motor fuels and having 0.002% or less mercaptan sulfur is contacted with oxygen dissolved in the hydrocarbon oil and from 0.002% to 0.06% by weight of the N-alkyl derivative of paraphenylene diamine also dissolved in the hydrocarbon, to convert the mercaptans to disulfides to sweeten the sour hydrocarbon oil.

U.S. Pat. No. 2,565,349 discloses the use of relatively large amounts of pyridine as a catalyst in the sweetening of sour petroleum distillate. The patent teaches that contacting the sour distillate with a mild oxidizing agent in the presence of 0.1% to 5.0% by volume pyridine and 0.1% to 5.0% by volume alkali solution at temperatures of from 60° F. to 200° F. will result in the conversion of some mercaptans to disulfides, thereby sweetening the sour distillate.

U.S. Pat. Nos. 3,408,287 and 3,409,543 disclose a sweetening process whereby a sour hydrocarbon stream is contacted with an oxidizing agent and a phthalocyanine catalyst in the presence of an alkali solution containing from 1.0% to 90% by volume of a polar-organic solvent selected from the group consisting of dialkyl sulfoxides, amino alcohols, amino-hydroxyalkyl ethers, alkyl amines, alkyl polyamides, alkyl amides and mixtures thereof. U.S. Pat. No. 3,409,543 further discloses regenerating the polar organic solvent containing alkali solution by conventional means.

U.S. Pat. No. 3,785,964 discloses a process for sweetening sour hydrocarbons whereby a sour hydrocarbon stream is contacted with a calcined copper-iron fixed bed catalyst in the presence of 0.0001% to 5% by weight of certain nitrogen compounds, preferably ammonia or pyridine.

U.S. Pat. No. 3,853,746 discloses the use of sulfuramides activated by a carbonyl or sulfonyl group adjacent to the sulfuramide nitrogen in the process of sweetening sour hydrocarbon distillates.

U.S. Pat. No. 4,039,586 discloses a process for oxidizing organic thiols to disulfides whereby the organic thiol is reacted with a xanthide in the presence of a tertiary amine.

U.S. Pat. Nos. 4,048,097; 4,078,992 and 4,088,569 disclose the use of an ammonium donor in the preparation of metal phthalocyanine catalyst composites.

U.S. Pat. Nos. 4,100,057; 4,142,964 and 4,168,245 disclose the use of small amounts of morpholine in the catalytic sweetening of sour petroleum distillate.

U.S. Pat. Nos. 4,121,997; 4,124,493; 4,124,494; 4,127,474; 4,156,641; 4,157,312; 4,159,964; 4,203,827; 4,206,079; 4,213,877; 4,250,022; 4,260,479; 4,276,194; 4,290,913 4,290,916; 4,290,917; 4,293,442; 4,295,993; 4,298,463; 4,299,729 and 4,308,169 disclose the use of ionic, quaternary ammonium compounds in processes for oxidizing mercaptan compounds.

U.S. Pat. No. 4,207,173 discloses the use of a tetraalkyl guanidine to supply the basic medium instead of an aqueous sodium hydroxide solution customarily used in the processes for sweetening sour hydrocarbons.

U.S. Pat. No. 4,502,949 discloses a process for sweetening sour hydrocarbons whereby the mercaptans contained in the hydrocarbon are reacted with an oxidizing agent by contacting the hydrocarbon and oxidizing agent with a supported metal chelate mercaptan oxidation catalyst and anhydrous ammonia in the absence of an aqueous phase.

U.S. Pat. No. 4,514,286 discloses a process for reducing the mercaptan concentration of a sour petroleum distillate by contacting the distillate with a hydroperoxide compound and a quaternary ammonium hydroxide salt.

The above-listed patents are also incorporated by reference herein for all purposes as if fully set forth.

None of the above-described processes or nitrogen compounds as utilized in those processes is applicable for use in a variety of processes or as both a promoter for extraction and catalytic oxidation. For example, the use of high concentrations of nitrogen compounds in the hydrocarbon stream as taught by some of the references may result in unwanted color problems with the product. Other of the processes are not applicable in conventional hydrocarbon caustic oxidizing agent oxidation catalyst systems which dominate the sweetening and regeneration operations. Further, many of the processes are not easily adaptable to such conventional systems.

It has now been surprisingly discovered that the extraction and catalytic oxidation of the mercaptan compounds is promoted by the addition of small amounts of selected nitrogen-based compounds, as described hereinafter. It has also been surprisingly discovered that such nitrogen-based compounds may be utilized in a variety of sweetening and regeneration processes, as is also described hereinafter.

SUMMARY OF THE INVENTION

In accordance with the present invention, improved methods for treating streams having mercaptan or mercaptan-based compounds therein are provided. The methods comprise, in their broadest concept, contacting a first stream having the mercaptan or mercaptan-based compounds therein with a second stream to either: (1) convert the mercaptan or mercaptan-based compounds to disulfide compounds; (2) extract the mercaptan, mercaptan-based or disulfide compounds; or (3) combinations thereof.

The first stream is either a sour hydrocarbon distillate or a spent caustic solution. If the first stream is a sour hydrocarbon distillate, the second stream is a caustic solution, and if the first stream is a spent caustic solution, the second stream is a hydrocarbon solvent.

The improvement comprises contacting the first and second streams in the presence of preferably from about 1 ppm to about 50 ppm, more preferably from about 1 ppm to about 10 ppm, most preferably from about 4 to about 6 ppm, by weight based upon the hydrocarbon stream of a nitrogen-based promoter having at least one nitrogen atom. The nitrogen-based promoters more preferably comprise non-electrolytic, substantially sulfur free organic compounds selected from the group consisting of: (1) heterocyclic compounds wherein the ring or rings thereof consist of carbon and nitrogen atoms; (2) substituted homocyclic compounds wherein at least one of the substituents attached to the ring or rings thereof comprises at least one nitrogen atom; (3) aliphatic compounds comprising at least one nitrogen atom; and (4) mixtures thereof. The heterocyclic compounds preferably comprise from about 3 to about 40 atoms, more preferably from about 4 to about 24 atoms, in the ring or rings thereof, while the homocyclic compounds more preferably comprise from about 3 to about 34 atoms, preferably from about 5 to about 24 atoms, in the ring or rings thereof.

The most preferred nitrogen-based promoters comprise those listed in Example 7 hereinafter.

The present invention is particularly adapted to the processes for sweetening sour hydrocarbon distillate by the catalytic oxidation of the mercaptan or mercaptan-based compounds, sweetening sour hydrocarbon distillates by the extraction of the mercaptan or mercaptan-based compounds, and regenerating spent caustic solutions containing mercaptides.

The present invention is also applicable in a variety of apparatus and the processes specifically adapted therefor. For example, the invention may be utilized in continuous, batch, cocurrent, countercurrent and the like operations; liquid-liquid, liquid-vapor, etc. processes; packed tower, bubble tray, stirred vessel, fiber contacting and other similar apparatus; fixed-bed catalyst, aqueous catalyst, etc. systems; and other variants too numerous to list. The invention, therefore, is applicable in most processes and apparatus relating to the sweetening of sour hydrocarbons and the regeneration of spent caustic solutions.

These and other features and advantages of the present invention will be more readily understood by those skilled in the art from a reading of the following detailed description with reference to the accompanying drawings.

DETAILED DESCRIPTION OF THE PREFERRED EMBODIMENT

Figure 1:
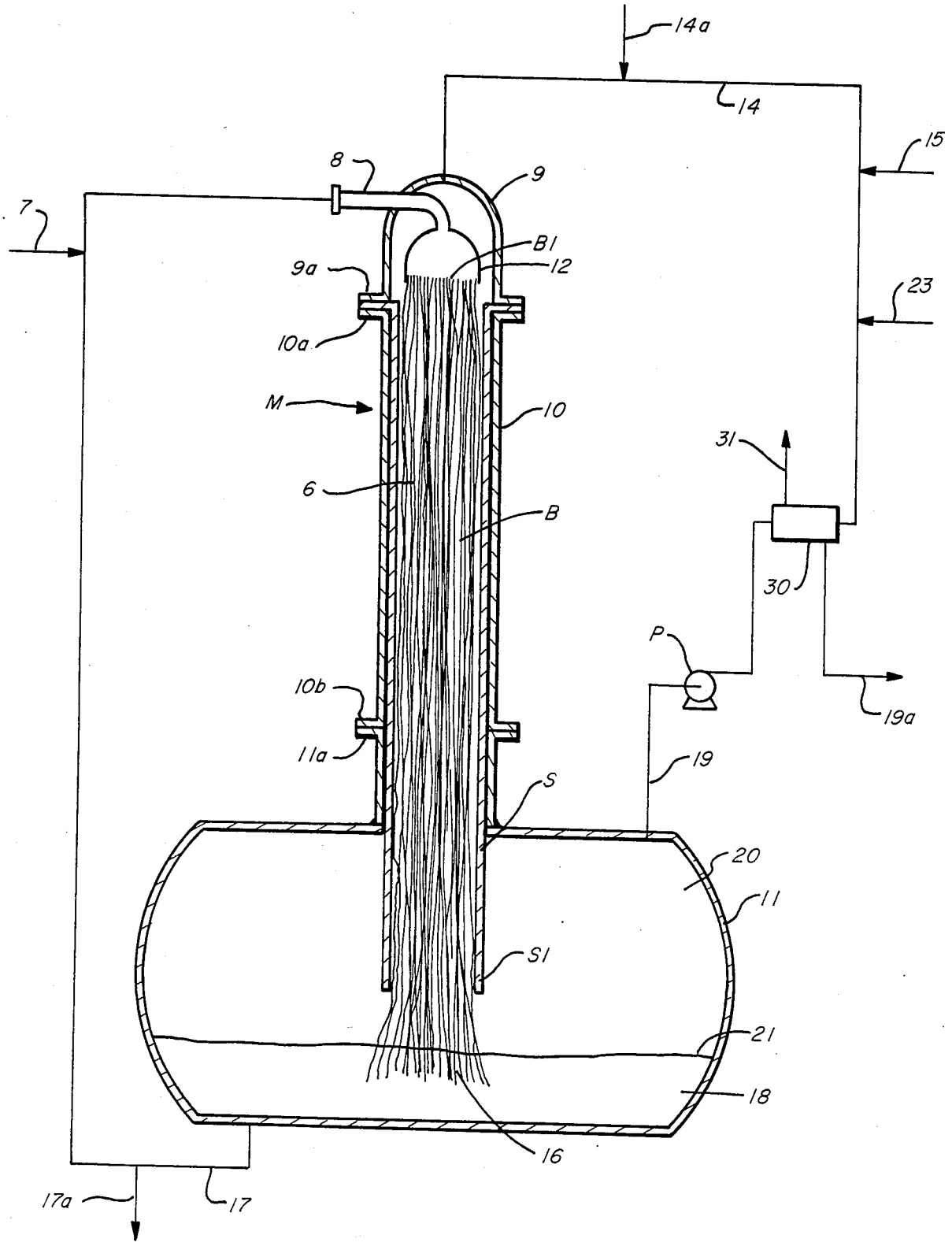
FIG. 1 illustrates a general schematic of a cocurrent liquid-liquid fiber mass transfer apparatus useful in the practice of this invention.

The present invention provides methods for treating streams containing mercaptan and mercaptan-based compounds. Mercaptan compounds are commonly defined, and defined for the purpose of this description, as hydrosulfide compounds containing the radical -SH. Mercaptan-based compounds are defined for the purposes of this description as derivatives of mercaptans such as, for example, mercaptides and disulfides. The present inventions particularly adapted for sweetening mercaptan-containing sour hydrocarbon distillate and regenerating spent caustic solutions utilized to extract mercaptan compounds from such distillate.

The invention, in its broadest sense, comprises an improvement over prior art sweetening and regeneration processes through the utilization of small amounts of nitrogen-based compounds as promoters for the extraction and oxidation reactions. A promoter is commonly defined as an accelerator, and is herein utilized to designate both an accelerator for the catalyst utilized in the many embodiments of the invention and as an extraction enhancer. The nitrogen-based promoters as used in the practice of this invention, therefore, both enhance the extraction of mercaptan-based compounds and accelerate the catalytic oxidation of such to provide improved sweetening and regeneration capabilities at minimum extra expense.

As previously mentioned, the improvement of this invention is particularly adapted for use in a variety of sweetening and regeneration processes. For example, in the process of sweetening sour hydrocarbon streams by the catalytic oxidation of the mercaptans to disulfides, the sour hyrocarbon stream is contacted with a caustic stream, oxidizing agent and mercaptan oxidation catalyst in the presence of a nitrogen-based promoter at a temperature and pressure and for a time sufficient to oxidize a portion of the mercaptans. The catalytic oxidation process has both extraction and oxidation aspects, as the mercaptans are extracted into the caustic stream in the form of mercaptides, wherein the mercaptides are oxidized to disulfides then back extracted into the hydrocarbon stream. The nitrogen-based promoters, through an unknown mechanism, promote both the extraction and oxidation steps.

Preferred operating temperatures range from about 60° F. to about 200° F., more preferably from about 90° F. to about 150° F., while preferred operating pressures range from atmospheric up to about 15 atmospheres. The actual reaction conditions, of course, depend on the specific sweetening process chosen as will be recognized by those skilled in the art.

The caustic stream is preferably an aqueous alkali metal hydroxide solution, most preferably sodium or potassium hydroxide, having a concentration of from about 5% to about 50%, more preferably from about 5% to about 25%, still more preferably from about 10% to about 20%, by weight alkali hydroxide. Such caustic solutions are widely used for the treatment of a variety of mercaptan containing hydrocarbon streams including, but not limited to, liquid petroleum gas (LPG), butanes, butenes, gasoline streams, jet fuels, kerosenes, naphthas and the like. The aforementioned hydrocarbon streams can typically contain a number of different mercaptan sulfur compounds, including, but not limited to, methyl mercaptan, ethyl mercaptan, n-propyl mercaptan, isopropyl mercaptan, n-butyl mercaptan, thiophenol and other branched and/or higher molecular weight mercaptans.

The oxidizing agent is preferably an oxygen containing gas, most preferably air, and is usually dissolved in the sour hydrocarbon stream prior to contact with the caustic stream but may be bubbled therethrough after contact. The oxidizing agent is preferably present in at least the stoichiometic amount necessary to oxidize all of the mercaptans, most preferably from about 100% to about 500% of the stoichiometric amount.

The mercaptan oxidation catalyst is preferably a metal chelate, more preferably a metal phthalocyanine. Any suitable phthalocyanine catalyst meeting the requirements of high activity and stability during use may be employed in the present invention. The catalyst is usually present as either being in solution with the caustic stream or as a composite in a fixed bed. Particularly preferred metal phthalocyanines include cobalt phthalocyanine and vanadium phthalocyanine; however, if the catalyst is to be soluble in the caustic stream, it is preferred that the catalyst be a phthalocyanine derivative, more preferably sulfonated and carboxylated derivatives, most preferably the disulfonated derivatives. Thus, the preferred catalyst comprises either cobalt phthalocyanine disulfonate or vanadium phthalocyanine disulfonate.

If the catalyst is in solution with the caustic stream, the preferred concentration of the catalyst is between about 5 ppm and about 1000 ppm, more preferably between about 5 ppm and about 500 ppm, still more preferably between about 10 ppm and about 200 ppm, by weight based on the caustic stream.

In addition to the mercaptan oxidation catalyst being in solution with the caustic stream, the catalyst, preferably a similar phthalocyanine catalyst, may be in the form of a composite with a suitable support. The support should be insoluble in, or substantially unaffected by the caustic stream and hydrocarbons under the conditions prevailing during the contact of the streams. Activated carbon is particularly preferred because of its high adsorptivity and stability under these conditions. Other carbon carriers include coke, charcoal which may be obtained from any suitable source including bone char, wood charcoal, charcoal made from cocoanut or other nut shells, fruit pits and similar sources. The choice of support will be made with reference to its adsorptive or spacing properties and its stability in the caustic stream and hydrocarbon stream under the reaction conditions as will be understood by those skilled in the art.

The composite of phthalocyanine and support may be prepared in any suitable manner. In one method the support may be formed into particles of uniform or irregular size and shape including spheres, prills, pellets, rings, saddles, flakes and the like and is then intimately contacted with a solution of phthalocyanine catalyst. An aqueous solution of phthalocyanine catalyst is prepared and, in the preferred embodiment, the support particles are soaked, dipped, suspended or immersed in the solution. In another method, the solution may be sprayed onto, poured over or otherwise contacted with the support. Excess solution may be removed in any suitable manner, and the support containing the catalyst is typically dried at temperatures of 180° F. and above, in an oven, by means of hot gases passed thereover or in any other suitable manner.

In general, it is preferred to composite as much catalyst with the support as will form a stable composite although a lesser amount may be so deposited if desired. In a typical preparation, about 1% by weight of phthalocyanine catalyst is composited with activated carbon by soaking granules of the carbon in a solution of phthalocyanine catalyst.

The nitrogen-based promoters are preferably introduced into the system as being dissolved in the sour hydrocarbon streams in amounts from about 1 ppm to about 50 ppm, more preferably from about 1 ppm to about 10 ppm, most preferably from about 4 to about 6 ppm, by weight upon the hydrocarbon stream. The nitrogen-based promoters may also be added to the system after contact of the hydrocarbon and caustic streams, or may be added to the caustic stream prior to contact with the hydrocarbon stream.

The nitrogen-based promoters preferably comprise non-electrolytic, substantially sulfur free organic compounds having at least one nitrogen atom and selected from the following groups: (1) heterocyclic compounds, wherein the ring or rings thereof consist of carbon and nitrogen atoms; (2) substituted homocyclic compounds, wherein at least one of the substituents attached to the ring or rings thereof comprising at least one nitrogen atom; (3) aliphatic compounds comprising at least one nitrogen atom; and (4) mixtures thereof. Non-electrolytic compounds are commonly defined, and defined for the purposes of this invention, as those compounds that do not easily dissociate into two or more ions in water. The heterocyclic compounds further preferably comprise from about 3 to about 40 atoms, more preferably, from about 4 to about 24 atoms, in the ring or rings thereof, and the homocyclic compounds further preferably comprise from about 3 to about 34 atoms, more preferably from about 5 to about 24 atoms, in the ring or rings thereof.

A representative, but by no means exhaustive, list of heterocyclic compounds useful in the practice of this invention is as follows: pyridine, picolene, nicotinonitrile, 1-phenol pyrrole, phenazine, pyradazine, pyrimidine, 2,2-bipyridine, quinoline, 2,2-biquinoline, methylpyrimidine, 2,4,6-triaminopyrimidine, triazine, melamine, methenamine, 3,4-diaminopyridine, 3-aminopyridine, acridine, quinaldine, isoquinoline, 4-aminopyrazolo [3,4-d]pyrimidine, 3-aminoquinoline, 7-azaindole, 5-triazolo [4,3-a]quinoline, 4-azabenzimidazole, pyrido(2,3-b)pyrazine, L-histidine, aminopiperidine, 2,2'-biquinoline, benzotriazole, quinoxaline, 1,2,4-triazole, 5-aminoindazole, triethylenediamine, aminopyrazole, 5,10,15,20-tetraphenyl 21H,23H porphine, pyrazine, aminopyrazine, 2-methylpyrazine, nicotine, 2-analinopyridine, 2-aminopyrimidine, 4-dimethylaminopyridine, benzimidazole, N-methyltolyimidazole, tolyimidazole, pyrrole, pyrrolidine, 4-methylpiperidine, 2,5 dimethylpyrrole, piperidine, 1-ethylpiperidine, 2-ethylpiperidine, piperazine, pyrazole, indole, 3-methylindole, 5-methylindole, indoline, polyvinyl piperidine, azabicyclo(3.2.2)nonane, phthalocyanine, homopiperazine, 1,4,8,12 tetraazacyclopentadicane, 5-aminoindole, carbazole, imidazole, N-alkylate imidazole, skatole, quinalidine, purine, 2,3-cyclopentenepyridine, penanthroline, etc.

A representative, but again by no means exhaustive, list of homocyclic compounds useful in the practice of this invention is as follows: N,N-dimethylbenzylamine, 4-aminopyrene, aniline, 2,5-dimethylaniline, 2,4-diaminotoluene, toluidine, cyclohexamine, tolunitrile, nitrobenzene, cyclopentylamine, cyclobutylamine, cyclopropylamine, 4-cyclohexylaniline, cyclooctylamine, aminoindane, napthylamine, amitriptyline, etc.

A representative, but once again by no means exhaustive, list of aliphatic nitrogen compounds useful in the practice of this invention is as follows: methylamine, urea, T-octylamine, octadecylamine, ethylenediamine, L-isoleucine, triethylene tetramine, butylamine, N-heptyl cyanide, etc.

The most preferred of these nitrogen compounds are 1-phenylpyrrole, pyradazine, pyrimidine, methylpyrimidine, methenamine, 3-aminoquinoline, s-tiazolo[4,3-a]quinoline, 4-azabenzimidazole, pyridopyrazine, 1,3,5 triazine, benzotriazole, pyrazine, 2-aminopyrimidine, 4-methylpiperidine, piperidine, azabicyclo[3,2,2]nonane, and 2,4-diaminotoluene.

As previously mentioned, the nitrogen-based promoters are utilized in amounts from about 1 ppm to about 50 ppm by weight based upon the hydrocarbon stream. Use of excess nitrogen-based promoter may cause unwanted problems such as, for example, color impurities which can result in a less desirable product, and may in fact decrease the efficiency of the use of the nitrogen-based compounds as promoters.

Also as previously mentioned, the nitrogen-based promoters are non-electrolytic. Because of this non-electrolytic nature, the promoters will be preferentially soluble in the hydrocarbon stream. As most hydrocarbon product specifications set an upper limit to the amount of sulfur allowable in the hydrocarbon product, it is highly desirable not to add additional sulfur to the hydrocarbon in any form. The nitrogen-based promoters, therefore, are not only non-electrolytic but also substantially sulfur free.

The improvement of this invention is also adapted for use in the process of sweetening sour hydrocarbon streams by the strict extraction of the mercaptan compounds therein, wherein the sour hydrocarbon stream is contacted with a caustic stream in the presence of the aforementioned nitrogen-based promoters at a temperature and pressure and for a time sufficient to extract at least a portion of the mercaptans. The temperature, pressure and composition of the caustic stream are preferably similar to the sweetening by catalytic oxidation process as discussed above; however, the exact process conditions again depend on which of the variety of processes is practiced with the invention as will be understood by those skilled in the art.

As earlier noted, the promoters, through an unknown mechanism, promote the extraction of the mercaptans from the hydrocarbon stream to the caustic stream in the form of mercaptides, which are preferentially soluble in the caustic stream. The caustic stream is then separated from the hydrocarbon stream, leaving a sweetened hydrocarbon product.

The resulting caustic stream is usually recycled in the extraction process until it is spent, that is, until the capacity of the caustic stream to extract mercaptans is so diminished that the process no longer runs efficiently. The spent caustic stream is then either discarded or regenerated for reuse.

In the regeneration process the mercaptide-containing caustic stream is contacted with a hydrocarbon stream, an oxidizing agent and a mercaptan oxidation catalyst in the presence of a nitrogen-based promoter. The composition of the oxidizing agent, mercaptan oxidation catalyst and nitrogen-based promoter and the reaction conditions are preferably the same as described above for the sweetening by catalytic oxidation process, and again specifically depend upon the process chosen with which to practice the invention as will be understood by those skilled in the art.

The present invention is also applicable in a variety of apparatus and the processes specifically adapted therefor. For example, this invention may be utilized in continuous, batch, cocurrent, countercurrent and the like operations; liquid-liquid, liquid-vapor, etc. processes; packed tower, bubble tray, stirred vessel, fiber contacting and other similar apparatus; fixed-bed catalyst, aqueous catalyst, etc. systems; and other variants too numerous to list. The invention, therefore, is applicable in most processes and apparatus relating to the sweetening of sour hydrocarbons and the regeneration of spent caustic solutions.

Referring now to FIG. 1, there is illustrated a general schematic of a cocurrent liquid-liquid mass transfer apparatus useful in the practice of this invention. The apparatus of FIG. 1 makes use of the mass transfer techniques and apparatus as disclosed in U.S. Pat. Nos. 3,977,829 and 3,992,156, and reference may be made to such patents for a full description thereof. It should here be noted that the present invention is not to be limited by its use with the apparatus of FIG. 1 nor is the use of the apparatus of FIG. 1 to be limited to the specific processes hereinafter described.

The mass transfer apparatus M of FIG. 1 includes a bundle B of substantially continuous elongated fibers 6 mounted in a shroud S and contained within conduit 10. Conduit 10 is provided with an inlet flange 10*a* that is adapted for connection or placement with mounting flange 9*a* of conduit inlet assembly 9. A fluid distribution means 12 is mounted within conduit inlet assembly 9 for distributing the caustic stream from caustic feed line 8 onto fibers 6 of fiber bundle B. A hydrocarbon feed line 14 is also attached to conduit inlet assembly 9 for delivering the hydrocarbon stream into conduit assembly 9.

Conduit 10 is also provided with an outlet flange 10*b* which is adapted for placement or connection with mounting flange 11*a* of collection vessel 11. Collection vessel 11, during the operation of mass transfer apparatus M, will contain a lower layer 18 of caustic solution and an upper layer 20 of hydrocarbon solution resulting from the processes of this invention as described hereinafter. Shroud S and fibers 6 of fiber bundle B extend partly within the confines of collection vessel 11, with the positioning of the downstream end 16 of fiber bundle B within collection vessel 11 being such that downstream end 16 is within the caustic solution collected as lower layer 18.

Fibers 6 that comprise fiber bundle B are selected to meet two criteria: (1) the fiber material must be preferentially wetted by the caustic solution introduced by feed line 8; and (2) the fibers must be of a material that will not contaminate the process or be destroyed by it, such as by corrosion. Accordingly, inasmuch as the processes of this invention deal with caustic solutions and hydrocarbons containing sulfur compounds, metallic fibers and, in particular, stainless steel or special corrosion resistant alloy fibers, are preferably employed.

A first specific embodiment of the invention utilizes the apparatus of FIG. 1 for sweetening sour hydrocarbon streams by the catalytic oxidation of the mercaptan compounds therein. A second specific embodiment of the invention utilizes the apparatus of FIG. 1 for sweetening sour hydrocarbon streams by the extraction of the mercaptan compounds therein. A third specific embodiment of the invention utilizes the apparatus of FIG. 1 for regenerating spent caustic solutions utilized in a mercaptan extraction process. Specific mechanical and operational details of mass transfer apparatus M will be provided below with the description of each specific embodiment of the invention. Other mechanical details of the mass transfer apparatus M not necessary to an understanding of the invention may be had by reference to the aforementioned patents.

In order to sweeten mercaptan-containing sour hydrocarbon streams according to the first specific embodiment, the caustic stream containing an oxidation catalyst is flowed through caustic feed line 8, into inlet assembly 9, to fluid distribution means 12 and onto the upstream end B1 of the fiber bundle B as illustrated in FIG. 1. Simultaneously, the sour hydrocarbon stream containing the nitrogen-based promoter and a dissolved oxygen-containing gas, such as air, is flowed through hydrocarbon feed line 14, into inlet assembly 9, and then cocurrently with and in intimate contact with the caustic stream, passing over fibers 6 of fiber bundle B contained within conduit 10, and then into collection vessel 11. During the time the two immiscible fluids are in contact within conduit 10, the mercaptans contained in the hydrocarbon stream are extracted into the caustic as mercaptides, oxidized to disulfides, then back-extracted into the hydrocarbon stream and are thus removed from the caustic solution.

The caustic streams herein utilized include, for example, aqueous potassium hydroxide solutions and aqueous sodium hydroxide solutions having concentration of from about 5% to about 50%, more preferably from about 5% to about 25%, still more preferably from about 10% to about 20%, by weight alkali hydroxide.

As previously mentioned, fibers 6 must be preferentially wetted by the caustic stream introduced by caustic feed line 8. If, however, the volumetric flow ratio of the hydrocarbon stream to caustic stream is less than about 1:1, phase inversion may occur resulting in fibers 6 being preferentially wetted by the hydrocarbon stream. It is preferred, therefore, that the volumetric flow ratio of the hydrocarbon stream to caustic stream be at least about 1:1, more preferably from about 2:1 to about 20:1, still more preferably about 3:1 to about 7:1, most preferably about 5:1.

The oxidation reaction will occur at temperatures of from ambient to about 200° F. The preferred operating temperature is from about 100° F. to about 130° F.

The oxidation reaction is relatively fast, however, sufficient time must be allowed for the mercaptans and/or oxygen to be transferred to the caustic stream and for the resulting disulfides to be transferred back into the hydrocarbon stream. Because of the efficiency of mass transfer apparatus M, residence time in fiber bundle B may be rather short, generally from about thirty seconds to about three minutes. Preferred residence times are from about one to about two minutes.

The oxidation catalyst contained in the caustic stream may be any suitable oxidation catalyst known to those skilled in the art and preferably comprises a metal phthalocyanine dissolved or suspended in the caustic stream entering the system through caustic feed line 8. Metal phthalocyanines that may be employed include cobalt phthalocyanine and vanadium phthalocyanine or sulfonated or carboxylated derivatives thereof. A preferred catalyst comprises cobalt phthalocyanine disulfonate. The catalyst concentration will vary depending in part on the level of mercaptans in the hydrocarbon stream, as will be understood by those skilled in the art. Typically, the amount of phthalocyanine catalyst may range from about 10 ppm to about 1000 ppm, more preferably from about 10 to about 500 ppm, still more preferably from about 10 ppm to about 200 ppm, by weight based upon the caustic stream.

The oxygen required for the oxidation of the mercaptans is introduced into the system through line 15 by dissolving oxygen or an oxygen-containing gas, such as air, in the hydrocarbon stream. In fiber bundle B, the oxygen is transferred from the hydrocarbon stream into the caustic stream. Oxygen thus is available for chemical reaction with the mercaptides in the presence of the oxidation catalyst contained in the caustic stream as the respective fluids move through fiber bundle B of mass transfer apparatus M. The amount of oxygen provided is at least equal to the stoichiometric amount required to oxidize all of the mercaptans to disulfides and generally is provided in excess of the stoichiometric amount, usually up to about 500% of the stoichiometric amount. The pressure in the system is maintained at a level such that the desired amount of oxygen can be dissolved into the hydrocarbon stream without exceeding the solubility limits for oxygen or the oxygen-containing gas in the hydrocarbon.

The higher the mercaptan concentration of the sour hydrocarbon stream, the more oxygen or oxygen-containing gas must be dissolved in the hydrocarbon, the higher system back pressure must be maintained in order to keep such amounts of oxygen-containing gas in solution. Typical system back pressures range from 10 psig to 100 psig with system back pressures of from about 25 psig to about 75 psig typically being sufficient for most normal mercaptan loadings.

The nitrogen-based promoters, the details of which have previously been described, are introduced into the system by injection through line 14*a* into the hydrocarbon stream. The nitrogen-based promoters are added to the hydrocarbon streams in amounts of from about 1 ppm to about 50 ppm, more preferably from about 1 ppm to about 10 ppm, most preferably from about 4 to about 6 ppm, by weight based upon the hydrocarbon stream.

The downstream end S1 of shroud S containing the fiber bundle B extends into collection vessel 11 sufficiently so as to allow end 16 of fiber bundle B to contact caustic lower layer 18. Thus, as the caustic and hydrocarbon streams flow from conduit 10 into collection vessel 11, the caustic stream, being immiscible with the sweetened hydrocarbon, separates and collects as lower layer 18 and the hydrocarbon stream, now containing disulfides, accumulates as upper layer 20 in collection vessel 11. Collection vessel 11, therefore, is preferably maintained at conditions which avoid entrainment of the hydrocarbon and caustic streams. The interface 21 between the hydrocarbon and caustic may vary, but it is preferred that the interface remain above end 16 of fiber bundle B as illustrated in FIG. 1. As a result of the oxidation of mercaptans to disulfides within fiber bundle B, a sweetened hydrocarbon is produced.

The sweetened hydrocarbon and caustic streams are withdrawn separately from the collection vessel 11. The caustic stream is withdrawn through caustic outlet line 17 and may be recycled for further use, for example, in further contacting of mercaptan-containing hydrocarbon streams. In a typical system, it may be necessary from time to time to purge some of the caustic solution from the recirculation loop through purge line 17*a* and replace it with fresh caustic solution from fresh caustic line 7. This is generally done as needed to control the buildup of carbonates from $CO_2$ in the oxidation air and thiosulfates and other sulfur compounds which may be present in the system due to the presence of hydrogen sulfide in the hydrocarbon stream. The addition of fresh caustic solution may also be necessitated due to the dilution effect resulting from the oxidation of the mercaptans wherein water is a co-product of the oxidation reaction.

The hydrocarbon stream is withdrawn from collection vessel 11 through hydrocarbon outlet line 19 and may be recovered through product line 19*a* or may be recycled to hydrocarbon feed line 14 for further treatment. In the latter event, it may be necessary to pass the hydrocarbon stream through a degassing zone 30 wherein the pressure is reduced by a suitable pressure relief valve P to enable the dissolved gases, primarily nitrogen if air is used as the oxygen source, to come out of solution and be separated therefrom through vent 31. This, of course, would not be necessary if oxygen itself were used in stoichiometric quantities for the oxidation.

It should here be noted that the catalytic sweetening process as detailed in this first specific embodiment may, for example, also be utilized in an apparatus similar to the one depicted in FIG. 1 except that the hydrocarbon and caustic streams are contacted in the presence of a fixed bed catalyst (not shown) as previously described instead of fiber bundle B. The process operating conditions are essentially same in either the fixed bed or fiber bundle apparatus except that the oxidation catalyst is contained within the fixed bed instead of, or in addition to, in solution with the caustic stream.

The sweetening process as previously described may also be utilized in an apparatus having both a fiber bundle and fixed bed catalyst contacting section, such as the apparatus disclosed and described in U.S. Pat. No. 4,675,100, assigned to the assignee of the present invention and incorporated by reference herein for all purposes as if fully set forth. Such an apparatus is especially effective for treating streams having difficulty oxidizable mercaptans.

Figure 2:
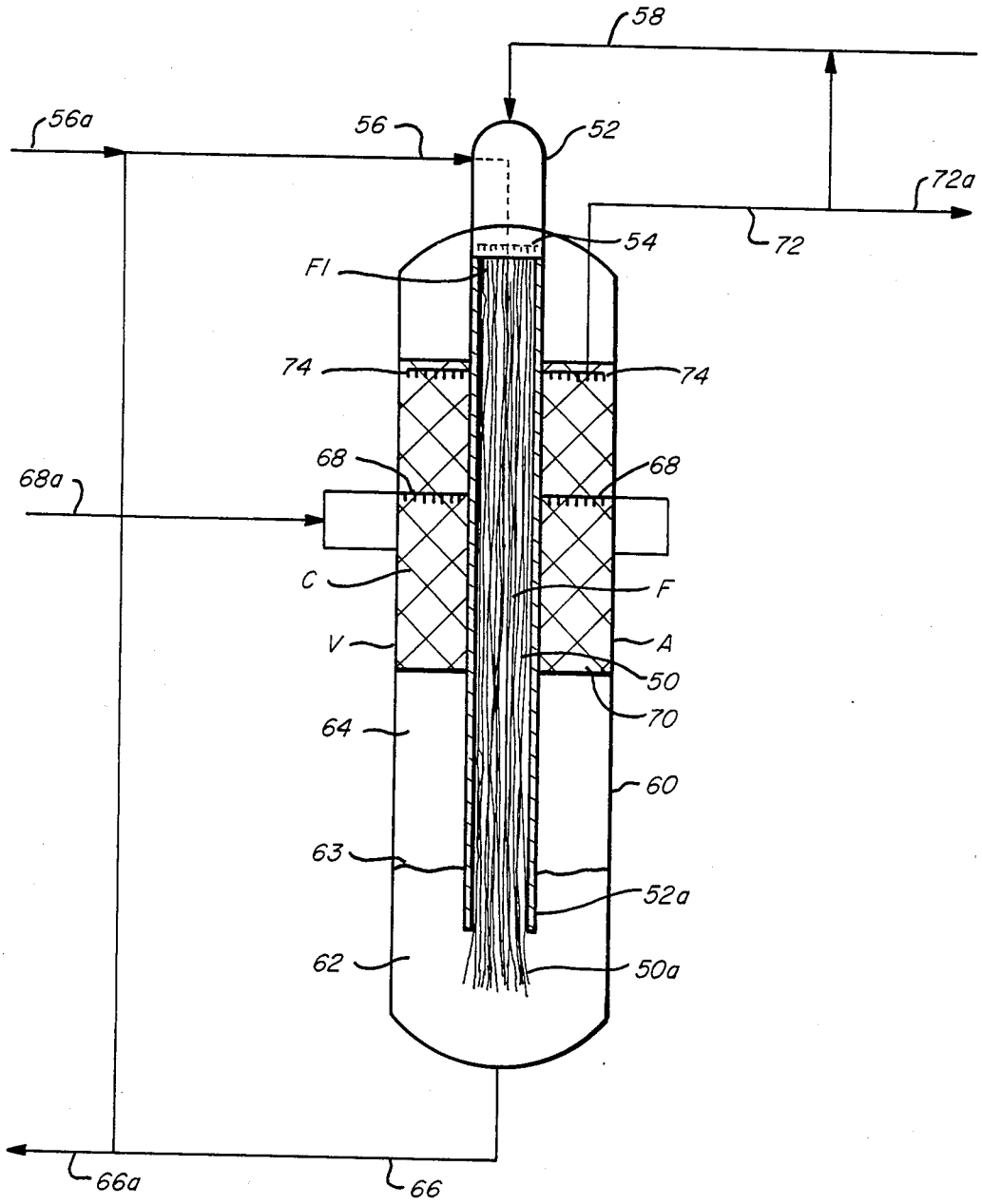
FIG. 2 illustrates a general schematic of a combination fiber bundle/fixed bed liquid-liquid mass transfer apparatus useful in the practice of this invention.

Referring now to FIG. 2, there is illustrated a schematic of a combination fiber bundle/fixed bed apparatus A such as disclosed and described in the above-mentioned patent application. Apparatus A includes a fiber bundle F of substantially continuous elongated fibers 50 contained within conduit 52. A fluid distribution means 54 is mounted within conduit 52 for distributing the caustic stream from caustic feed line 56 onto fibers 50 of fiber bundle F. A hydrocarbon feed line 58 is also provided for delivering the hydrocarbon stream into conduit 52.

At the downstream end 52*a* of conduit 52 is a collection vessel 60 into which the downstream end 50*a* of fibers 50 extend. Collection vessel 60 is preferably integrated with the vessel V enclosing conduit 52.

Collection vessel 60, during the operation of apparatus A, contains a lower layer 62 of caustic solution and an upper layer 64 of hydrocarbon solution. Downstream end 50*a* of fibers 50 are positioned within collection vessel 60 such that downstream end 50*a* is within the caustic solution collected as lower layer 62.

Apparatus A is also provided with a fixed catalyst bed C preferably in annular arrangement around conduit 52. Fixed catalyst bed C comprises a mercaptan oxidation catalyst composited on a suitable support, such as the supported catalysts previously described. Catalyst bed C is supported in vessel V by a restraining means 70 such as a screen or other suitable device as will be recognized by those skilled in the art.

Other mechanical details of apparatus A are not necessary to an understanding of the invention. Most of the operating parameters of apparatus A, such as the caustic and hydrocarbon stream compositions, operating temperatures and pressures, and compositions of the oxidizing agents, mercaptan oxidation catalysts and nitrogen-based promoters, are essentially the same as in apparatus M of FIG. 1, the details of which have previously been discussed and to which reference may be made.

In order to sweeten mercaptan-containing compounds utilizing apparatus A of FIG. 2, a caustic stream containing a mercaptan oxidation catalyst is flowed through caustic feed line 56 to fluid distribution means 54 and onto the upstream end F1 of fiber bundle F. Simultaneously, the sour hydrocarbon stream containing the nitrogen-based promoter and oxidizing agent is flowed through hydrocarbon feed line 58, into conduit 52 and then cocurrently with and in intimate contact with the caustic stream, passing over fibers 50 of fiber bundle F and then into collection vessel 60. During the time the hydrocarbon and caustic streams are in contact, a portion of the mercaptans is catalytically oxidized to disulfides. As the caustic and hydrocarbon streams flow from conduit 52 into collection vessel 60, the caustic stream, being immiscible with the hydrocarbon stream, separates and collects as lower layer 62 while the hydrocarbon stream, now having disulfides and the remaining mercaptans therein, accumulates as upper layer 64 in collection vessel 60. The interface 63 within collection vessel 60 is preferably kept at a level above downstream end 50*a* of fibers 50 so that the caustic stream can be collected directly in the bottom of collection vessel 60 without it being dispersed into the hydrocarbon stream.

The caustic stream is withdrawn through caustic outlet line 66 and may be recycled for further use. In a typical system, it may be necessary from time to time to purge some of the caustic solution from the recirculation loop through purge line 66*a* and replace it with fresh caustic from fresh caustic line 56*a* for essentially the same reasons as mentioned in relation to the other catalytic oxidation processes.

The hydrocarbon stream, upon disengagement from fiber bundle F and collection as upper layer 64, moves up through catalyst bed C, wherein it is contacted by fresh caustic introduced into catalyst bed C from fresh caustic line 68*a* through distributors 68 placed within catalyst bed C. While placement of distributors 68 is arbitrary within catalyst bed C, they should be placed toward the top 25% of the bed to allow sufficient contact between the caustic and the remaining mercaptans in the hydrocarbon stream. The fresh caustic is preferably the same composition as the other caustic solutions utilized herein and may or may not contain a mercaptan oxidation catalyst depending upon such factors as the amount and type of mercaptans remaining in the hydrocarbon stream and the efficiency of the catalyst in catalyst bed C, as will be understood by those skilled in the art. The caustic stream exits catalyst bed C through restraining means 70 into collection vessel 60, wherein it settles and is accumulated into lower layer 62.

The sweetened hydrocarbon is removed from catalyst bed C and vessel V through hydrocarbon outlet line 72 via collection means 74, which can be any means suitable for removing the hydrocarbon stream from vessel V, as will be recognized by those skilled in the art. The hydrocarbon stream may then be removed as product through hydrocarbon product line 72*a* or may be recycled into hydrocarbon feed line 58 for further treatment. In the latter event, and under certain conditions as earlier detailed, it may be necessary to pass the hydrocarbon stream through a degassing zone (not pictured) where the pressure is reduced by a suitable pressure relief valve to enable any dissolved gases to come out of solution with the hydrocarbon stream and be separated therefrom.

The use of the nitrogen-based promoters in conjunction with the first specific embodiment and modifications thereof significantly increases the efficiency of the sweetening processes as indicated by the examples presented hereinafter. The efficiency of these sweetening processes will also depend on a number of other parameters such as, for example, including the rates of mass transfer of oxygen into the caustic stream to provide the oxygen for the catalytic oxidation of the mercaptans, the rate of flow of streams entering the feed lines, the amounts of dissolved oxygen in the hydrocarbon stream, the amount of catalyst contained in the caustic stream, residence time of the respective materials within the mass transfer apparatus, temperature and pressure conditions, the chemical composition of sulfur compounds contained in the hydrocarbon stream to be sweetened, the type of caustic stream used, and other factors as will be recognized by those skilled in the art. Based on the improved results utilizing the nitrogen-based promoters, one skilled in the art will know how to adjust these parameters accordingly.

The second specific embodiment of this invention, as previously mentioned, utilizes the apparatus of FIG. 1 for sweetening sour hydrocarbons by the extraction of the mercaptan compounds therein. Referring again to FIG. 1, in order to sweeten mercaptan-containing sour hydrocarbon streams according to the second specific embodiment, the caustic stream is flowed through caustic feed line 8 into inlet assembly 9 and to fluid distrubution means 12 and onto upstream end B1 of fiber bundle B as illustrated in FIG. 1. Simultaneously, the sour hydrocarbon stream containing the nitrogen-based promoter is flowed through hydrocarbon feed line 14, into inlet assembly 9, and then concurrently with and in intimate contact with the caustic stream, passing over fibers 6 of fiber bundle B contained within conduit 10, and then into collection vessel 11. During the time the two immiscible fluids are in contact within conduit 10, the mercaptans contained in the hydrocarbon stream are extracted into the caustic as mercaptides and are thus removed from the hydrocarbon stream.

As in the previous embodiments, the caustic streams utilized include, for example, aqueous potassium hydroxide solutions and aqueous sodium hydroxide solutions, having a concentration of from about 5% to about 50%, more preferably from about 5% to about 25%, still more preferably from about 10% to about 20%, by weight alkali hydroxide.

Also as in the previous embodiments, fibers 6 must be preferentially wetted by the caustic stream introduced by caustic feed line 8. If, however, the volumetric flow ratio of the hydrocarbon stream to caustic stream is less than about 1:1, phase inversion may occur resulting in fibers 6 being preferentially wetted by the hydrocarbon stream. It is preferred, therefore, that the volumetric flow ratio of the hydrocarbon stream to caustic stream be at least about 1:1, more preferably from about 2:1 to about 20:1, still more preferably about 3:1 to about 7:1, most preferably about 5:1.

The extraction of the mercaptans from the hydrocarbon stream is relatively fast, however, sufficient time must be allowed for the mercaptans to be transferred to the caustic stream as mercaptides. Because of the efficiency of mass transfer apparatus M, residence time in the fiber bundle may be rather short, generally from about thirty seconds to about three minutes. Preferred residence times are from about one to about two minutes.

The nitrogen-based promoters, the details of which have previously been described, are introduced into the system by injecting the nitrogen-based promoters through line 14*a* into the hydrocarbon stream. The nitrogen-based promoters are added to the hydrocarbon streams in amounts of from about 1 ppm to about 50 ppm, more preferably from about 1 ppm to about 10 ppm, most preferably from about 4 to about 6 ppm, by weight based on the hydrocarbon stream. The nitrogen-based promoters may also be added to the system after contact of the hydrocarbon and caustic streams, added to the caustic stream prior to contact with the hydrocarbon stream, or added in a solution with another hydrocarbon diluent.

The downstream end S1 of the shroud S containing fiber bundle B extends into collection vessel 11 sufficiently so as to allow end 16 of fiber bundle B to contact caustic lower layer 18. Thus, as the caustic and hydrocarbon streams flow from conduit 10 into collection vessel 11, the caustic stream, being immiscible with the sweetened hydrocarbon, separates and collects as lower layer 18 and the hydrocarbon stream accumulates as upper layer 20 in collection vessel 11. Collection vessel 11 is, therefore, maintained at conditions which avoid entrainment of the hydrocarbon and caustic streams. The interface 21 between the hydrocarbon and caustic may vary, but it is preferred that the interface remain above end 16 of fiber bundle B as illustrated in FIG. 1. As a result of the extraction of the mercaptan compounds into the caustic stream within the fiber bundle B, a sweetened hydrocarbon stream is produced.

The sweetened hydrocarbon and the caustic streams are withdrawn separately from collection vessel 11. The caustic stream is withdrawn through caustic outlet line 17 and may be recycled for further use, for example, in further contacting the mercaptan-containing hydrocarbon streams. The caustic stream may be recycled several times until it is spent, that is, until the capacity of the caustic stream to extract the mercaptan compounds has diminished to such an extent as to make the process inefficient. In a typical system, therefore, it may be necessary from time to time to purge some of the caustic solution from the recirculation loop through purge line 17*a* and replace it with fresh caustic solution from fresh caustic line 7. The purged, or spent, caustic is normally discarded or regenerated for reuse in the extraction process by any one of a number of regeneration processes.

The sweentened hydrocarbon stream may be recovered through product line 19*a* or may be recycled to the inlet line 14 for further treatment.

The use of the nitrogen-based promoters in conjunction with the second specific embodiment and modifications thereof significantly increases the efficiency of the extraction processes as indicated by the examples presented hereinafter. The efficiency of these extraction processes will also depend on a number of other parameters such as, for example, the rate of flow of streams entering feed lines 8 and 14, residence time of the respective materials within mass transfer apparatus M, temperature and pressure conditions, the chemical composition of sulfur compounds contained in the hydrocarbon stream to be sweetened, the type of caustic stream used, and other factors as will be recognized by those skilled in the art. Based on the improved results utilizing the nitrogen-based promoters, one skilled in in the art will know how to adjust these parameters accordingly.

The third specific embodiment of this invention, as previously mentioned, utilizes the apparatus of FIG. 1 for regenerating spent caustic solutions utilized in a mercaptan extraction process, such as, for example, the process described in the second specific embodiment.

The spent caustic streams which may be regenerated include, for example, spent aqueous potassium hydroxide solutions and spent aqueous sodium hydroxide solutions having an initial concentration of from about 5% to about 50%, more preferably from about 5% to about 25%, still more preferably about 10% to about 20%, by weight alkali hydroxide. Such caustic solutions are widely used for treatment of a variety of mercaptan containing hydrocarbon streams, including liquid petroleum gas (LPG), butanes, butenes, gasoline streams, jet fuels, kerosenes, naphthas and the like. The spent caustic solutions resulting from the treatment of the aforementioned hydrocarbon streams can typically contain a number of different mercaptan sulfur compounds, including, for example, such mercaptans as methyl mercaptan, ethyl mercaptan, n-propyl mercaptan, iso-propyl mercaptan, n-butyl mercaptan thiophenol and branched and/or higher molecular weight mercaptans. Alkali metal sulfides can also be in the spent caustic solutions due to the presence of hydrogen sulfide in the hydrocarbon streams which were previously treated with the alkaline solution. The presence of such does not adversely affect the efficiency of the present invention.

In order to regenerate mercaptide-containing caustic streams according to the third specific embodiment, the spent caustic stream containing an oxidation catalyst is flowed through caustic feed line 8 into the inlet assembly 9 and to fluid distribution means 12 and onto the upstream end B1 of the fiber bundle B as illustrated in FIG. 1. Simultaneously, a suitable hydrocarbon solvent containing the nitrogen-based promoter and a dissolved oxygen-containing gas such as air, is flowed through hydrocarbon feed line 14, into inlet assembly 9, and then cocurrently with and in intimate contact with the caustic stream, passing over fibers 6 of fiber bundle B contained within conduit 10, and then into collection vessel 11. During the time the two immiscible fluids are in contact within conduit 10, the mercaptides contained in the spent caustic solution are oxidized to disulfides then extracted into the hydrocarbon solvent and are thus removed from the caustic solution.

Again as previously mentioned, fibers 6 must be preferentially wetted by the caustic stream introduced by feed line 8. If, however, the volumetric flow ratio of the hydrocarbon solvent to caustic stream is less than about 1:1, phase inversion may occur resulting in fibers 6 being preferentially wetted by the hydrocarbon solvent. It is preferred, therefore, that the volumetric flow ratio of the hydrocarbon solvent to caustic stream by at least about 1:1, more preferably from about 2:1 to about 20:1, still more preferably about 3:1 to about 7:1, most preferably about 5:1.

The oxidation reaction will occur at temperatures of from ambient to about 200° F. The preferred operating temperature is from about 100° F. to about 130° F.

The oxidation reaction is relatively fast, however, sufficient time must be allowed for the oxygen to be transferred to the caustic stream and for the resulting disulfides to be transferred back into the hydrocarbon stream. Because of the efficiency of the mass transfer apparatus, residence time in fiber bundle B may be rather short, generally from about thirty seconds to about three minutes. Preferred residence times are from about one to about two minutes.

The oxidation catalyst contained in the caustic stream may be any suitable oxidation catalyst known to those skilled in the art and preferably comprises a metal phthalocyanine dissolved or suspended in the caustic stream entering the system through caustic feed line 8. Metal phthalocyanines that may be employed include cobalt phthalocyanine and vanadium phthalocyanine or sulfonated or carboxylated derivatives thereof. A preferred catalyst comprises cobalt phthalocyanine disulfonate. The catalyst concentration will vary depending in part on the level of mercaptides in the caustic stream, as will be understood by those skilled in the art. Typically, the amount of cobalt phthalocyanine disulfonate may range from about 10 ppm to about 1000 ppm, more preferably from about 10 ppm to about 500 ppm, still more preferably about 10 ppm to about 100 ppm, by weight based on the caustic solution.

The oxygen required for the oxidation of the mercaptides is introduced into the system through line 15 by dissolving oxygen or an oxygen-containing gas, such as air, in the hydrocarbon solvent. In fiber bundle B, the oxygen is transferred from the hydrocarbon solvent into the caustic stream. Oxygen thus is available for chemical reaction with the mercaptides in the presence of the oxidation catalyst contained in the spent caustic stream as the respective fluids move through fiber bundle B of mass transfer apparatus M. The amount of oxygen provided is at least equal to the stoichiometric amount required to oxidize all of the mercaptides to disulfides and generally is provided in excess of the stoichiometric amount, usually up to about 500% of the stoichiometric amount. The pressure in the system is maintained at a level such that the desired amount of oxygen can be dissolved into the hydrocarbon stream without exceeding the solubility limits for oxygen or the oxygen-containing gas in the hydrocarbon.

The higher the mercaptide concentration of the spent caustic to be regenerated, the more oxygen or oxygen-containing gas must be dissolved in the hydrocarbon, and higher system back pressure must be maintained in order to keep such amounts of oxygen-containing gas in solution. Typical system back pressures range from 10 psig to 100 psig with system back pressures of from about 25 psig to about 75 psig typically being sufficient for most normal loadings.

The nitrogen-based promoters, the details of which have previously been described, are introduced into the system by injecting the nitrogen-based promoters through line **14*a*** into the hydrocarbon solvent. The nitrogen-based promoters are added to the hydrocarbon in amounts from about 1 ppm to about 50 ppm, more preferably from about 1 ppm to about 10 ppm, most preferably from about 4 to about 6 ppm, by weight based on the hydrocarbon solvent.

Any suitable hydrocarbon solvent which is immiscible with the caustic stream and does not otherwise adversely affect the overall process may be utilized. For example, many of the hydrocarbon streams treatable for mercaptan removal with caustic streams may be employed as the solvent. Use of the hydrocarbon which has previously been treated by the caustic stream such as aromatics, gasoline, hexane, kerosene, naphtha or mixtures of any such organic solvents will avoid the possibility of contamination of the hydrocarbon stream by solvent which is entrained in the recirculating caustic stream.

The downstream end S1 of shroud S containing fiber bundle B extends into collection vessel 11 sufficiently so as to allow end 16 of fiber bundle B to contact the regenerated caustic lower layer 18. Thus, as the caustic and hydrocarbon streams flow from conduit 10 into collection vessel 11, the regenerated caustic stream, being immiscible with the hydrocarbon, separates and collects as lower layer 18 and the hydrocarbon solvent, now containing disulfides, accumulates as upper layer 20 in collection vessel 11. Collection vessel 11, therefore, is preferably maintained at conditions which avoid entrainment of the hydrocarbon and caustic streams. The interface 21 between the solvent and regenerated caustic solution may vary, but it is preferred that the interface remain above end 16 of fiber bundle B as illustrated in FIG. 1. As a result of the simultaneous oxidation of mercaptides to disulfides and extraction of the disulfides into the solvent within fiber bundle B, a regenerated caustic stream of reduced mercaptide content is produced.

The hydrocarbon and the regenerated caustic streams are withdrawn separately from the collection vessel 11. The regenerated caustic stream is withdrawn through caustic outlet line 17 and may be recycled for further treatment in the aforementioned regeneration process or for further use, for example, in contacting mercaptan-containing hydrocarbon streams. In a typical regeneration system, it may be necessary from time to time to purge some of the regenerated caustic solution from the recirculation loop and replace it with fresh or other spent caustic solution. This is generally done as needed to control the build-up of carbonates from $CO_2$ in the oxidation air or thiosulfates or other sulfur compounds which may be present in the system due to the presence of hydrogen sulfide in the hydrocarbon stream being treated with the caustic solution prior to the regeneration step. The addition of fresh or other spent caustic solution may also be necessitated due to the dilution effect resulting from the oxidation of the mercaptides wherein water is a co-product of the oxidation reaction.

The hydrocarbon solvent containing disulfide compounds is withdrawn from collection vessel 11 through hydrocarbon outlet line 19 and may be processed further to recover the disulfide component therefrom, may be discarded in an environmentally safe manner, or may be recycled to hydrocarbon feed line 14 for further use in the process of the present invention. In the latter event, it may be necessary to pass the solvent solution through a degassing zone 30 wherein the pressure is reduced by a suitable pressure relief valve P to enable the dissolved gases, primarily nitrogen if air is used as the oxygen source, to come out of solution and be separated therefrom through vent 31. This, of course, would not be necessary if oxygen itself were used in stoichiometric quantities for the oxidation. Also, since the solvent loses its effectiveness as the level of disulfides increases, it may be desirable to remove some of the disulfide-containing solvent through line 19 and to add fresh, lean solvent through line 23 from time to time in a continuous mode in order to maintain the proper efficiency of extraction of disulfides.

The use of the nitrogen-based promoters in conjunction with the third specific embodiment and modifications thereof significantly increases the efficiency of the regeneration processes as indicated by the examples presented hereinafter. The efficiency of the regeneration processes will also depend on a number of other parameters such as, for example, the rates of mass transfer of oxygen into the caustic stream to provide the oxygen for the catalytic oxidation of the mercaptides to disulfides, the rates of extraction of the resulting disulfide from the alkaline stream into the solvent, the rate of flow of streams entering feed lines 8 and 14, the amounts of dissolved oxygen in either of the reactant streams, the amount of catalyst contained in the caustic stream, the residence time of the respective materials within mass transfer apparatus M, temperature and pressure conditions, the chemical composition of sulfur compounds contained in the alkaline stream to be regenerated, the type of hydrocarbon solvent used, and other factors as will be recognized by those skilled in the art. Based on the improved results utilizing the nitrogen-based promoters, one skilled in the art will know how to adjust these parameters accordingly.

Figure 3:
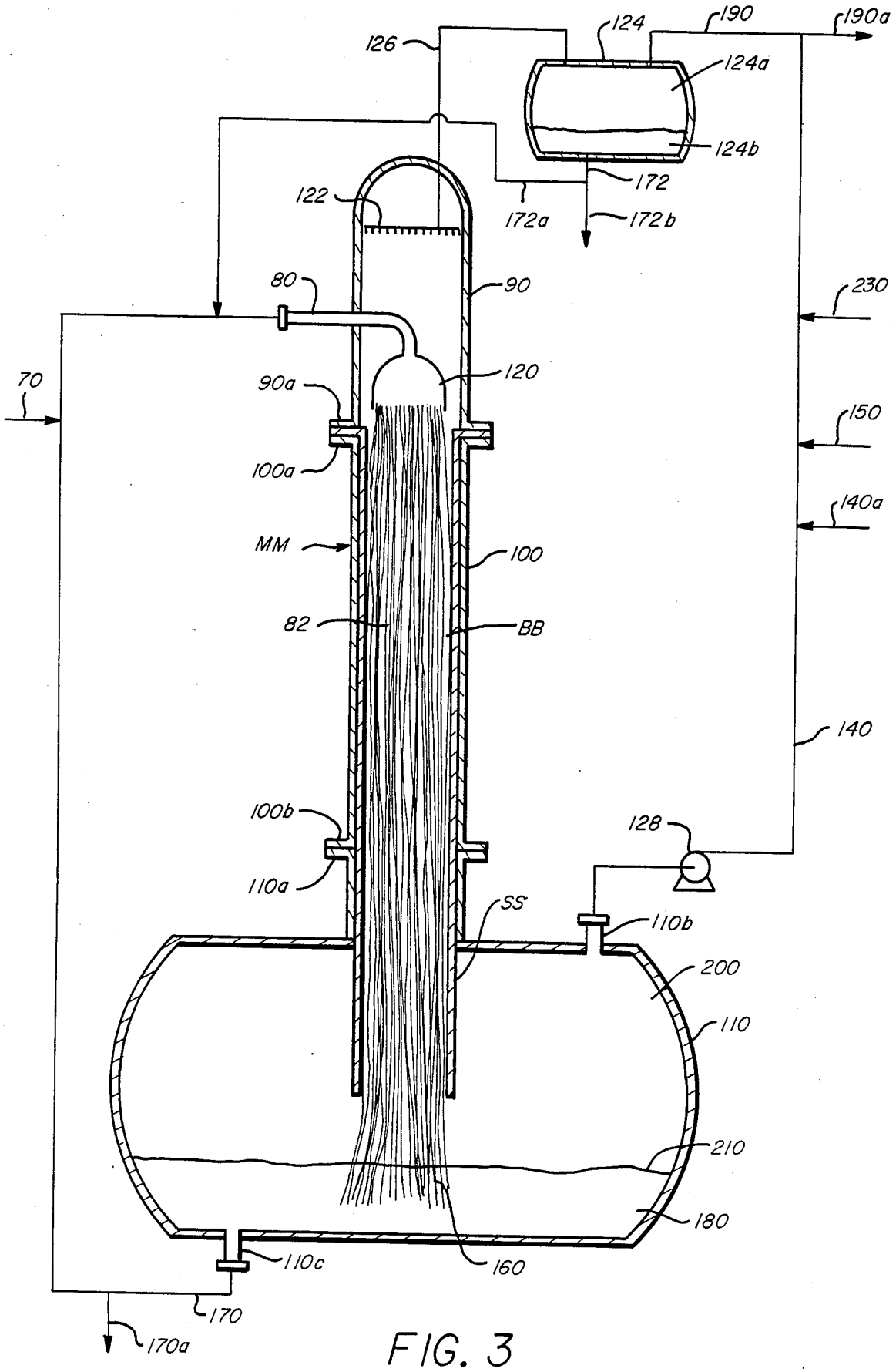
FIG. 3 illustrates a general schematic of a countercurrent liquid-liquid fiber mass transfer apparatus useful in the practice of this invention.

Referring now to FIG. 3, there is illustrated a general schematic of a countercurrent liquid-liquid mass transfer apparatus useful in the practice of this invention. The apparatus of FIG. 3 is particularly adapted for the sweetening by catalytic oxidation, sweetening by extraction, and regeneration processes previously described. It should again be noted, however, that the invention herein disclosed and described is not to be limited by its use with the apparatus of FIG. 3 nor is the use of the apparatus of FIG. 3 to be limited to the specific processes herein described.

In light of the previous detailed discussion of the sweetening and regeneration processes, and in light of the simularity of operating conditions between the apparatus of FIG. 1 and FIG. 3, the general details of the aforementioned processes and certain specific details of the apparatus need not be described again, and reference may be made to the earlier discussion for such details. For example, the amounts and compositions of the hydrocarbon streams, caustic streams, oxidation catalyst, nitrogen-based promoters and the like are similar for both apparatus. Further the fibers of the fiber bundle, operating temperatures and pressures, residence times and the like are also similar for both apparatus. Only those conditions necessary to an understanding of to the operation of the apparatus of FIG. 3 will be mentioned.

The mass transfer apparatus MM of FIG. 3 includes a bundle BB of substantially continuous elongated fibers 82 mounted in a shroud SS and contained within conduit 100. Conduit 100 is provided with a flange **100*a* that is adapted for connection or placement with mounting flange 90*a* of conduit cap assembly 90. A fluid distribution means 120 is mounted within the lower portion of conduit cap assembly 90 for distributing the caustic stream from caustic feed line 80 onto fibers 82 of fiber bundle BB. a fluid gathering means 122 is mounted within the upper portion of conduit cap assembly 90 for gathering the hydrocarbon stream and any entrained caustic stream which has flowed upward through conduit 100 as will be explained below. A fluid outlet line 126 is attached to fluid gathering means 122 for withdrawing the gathered fluids from conduit cap assembly 90. Such gathered fluids are delivered by fluid outlet line 126 to separator 124**, the purpose of which is described below.

Conduit 100 is also provided with a flange **100*b* which is adapted for placement or connection with mounting flange 110*a* of collection vessel 110. Collection vessel 110, during the operation of mass transfer apparatus MM, will contain a lower layer 180 of caustic solution and an upper layer 200 of hydrocarbon solution. Shroud SS and fibers 82 of fiber bundle BB extend partly within the confines of collection vessel 110, with the positioning of the downstream end 160 of fiber bundle BB within the caustic solution collected as lower layer 180**.

A hydrocarbon feed line 140 is attached to the collection vessel inlet **110*b* for delivering the hydrocarbon stream into the collection vessel 110. A caustic outlet line 170 is attached to the collection vessel outlet 110*c* for removing the caustic stream from the collection vessel 110**.

Other mechanical details of mass transfer apparatus MM are not necessary to an understanding of the invention, and may be had by referring to the discussion of mass transfer apparatus M of FIG. 1 and the references mentioned therein.

In the operation of the apparatus of FIG. 3, the caustic stream is flowed through caustic feed line 80, into fluid distribution means 120 and down fiber bundle BB to wet fibers 82. The hydrocarbon stream is simultaneously pumped by pump 128 through collection vessel inlet **110*b* and into the collection vessel 110 at sufficient pressures and rates so that the hydrocarbon stream will flow upward through the conduit 100 and thus into contact with the caustic stream wetting fibers 82** of fiber bundle BB.

If mass transfer apparatus MM is being utilized for a catalytic sweetening process, the caustic stream will generally comprise a caustic feed having a mercaptan oxidation catalyst therein and the hydrocarbon stream will generally comprise a sour hydrocarbon distillate having an oxidizing agent and the nitrogen-based promoter therein. If mass transfer apparatus MM is being utilized for an extraction sweetening process, the caustic stream will generally comprise only the caustic feed and the hydrocarbon stream will generally comprise only the sour hydrocarbon distillate with the nitrogen-based promoter therein. If mass transfer apparatus MM is being utilized for a regeneration process, the caustic stream will generally comprise a spent caustic solution having the mercaptan oxidation catalyst therein and the hydrocarbon stream will generally comprise a hydrocarbon solvent having the oxidizing agent and the nitrogen-based promoter therein.

After contact with the caustic stream, the hydrocarbon stream continues to flow upward through conduit 100 and into conduit cap assembly 90, wherein the hydrocarbon stream and any caustic entrained therein are gathered by fluid gathering means 122, removed from apparatus MM through fluid outlet line 126, then delivered into separator 124. Separator 124 is preferably a gravity separator similar to collection vessel 110 wherein the immiscible caustic and hydrocarbon streams are separated. The hydrocarbon stream is collected as upper layer 124*a* and removed from separator 124 through hydrocarbon outlet 190, from which it may be recovered through product line 190 or may be recycled to hydrocarbon feed line 140 for further processing. In the latter event, and under certain conditions as earlier detailed, it may be necessary to pass the hydrocarbon stream through a degassing zone (not pictured) where the pressure is reduced by a suitable pressure relief valve to enable any dissolved gases to come out of solution with the hydrocarbon stream and be separated therefrom.

The caustic stream is collected as lower layer 124*b* and recovered from separator 124 through caustic outlet 172 and may be recycled through recycle line 172*a* to caustic feed line 80 or purged through purge line 172*b*.

After contact with the hydrocarbon stream in conduit 100, the caustic stream and any hydrocarbon entrained therein continue to flow down fiber bundle BB and into collection vessel 110, wherein the two immiscible streams separate. The hydrocarbon stream accumulates as upper layer 200 where it is recycled through the system. The caustic stream accumulates as lower layer 180 and is withdrawn from collection vessel 110 through collection vessel outlet 110*c* and into caustic outlet line 170. The caustic stream may then be recovered through caustic product line 170*a* or may be recycled to caustic inlet line 80 for further processing.

Depending upon the specific process utilized with the apparatus of FIG. 3, it may be necessary to add fresh caustic and hydrocarbons to the system. Fresh caustic or caustic having the oxidation catalyst therein may be added through caustic feed line 70. Fresh hydrocarbon may be added through hydrocarbon feed line 230. If required, oxygen or oxygen-containing gas may be added to the hydrocarbon stream through line 150, and nitrogen-based promoter may be added through line 140*a*.

The use of the nitrogen-based promoters in conjunction with the sweetening and regeneration processes utilizing apparatus MM of FIG. 3 also significantly increases the efficiency of these processes as indicated by the examples presented hereinafter. The efficiency of these processes will also depend on a number of other parameters such as, for example, the rates of mass transfer, the rates of flow of the hydrocarbon and caustic streams, the residence times of the respective streams, the temperatures and pressures at which the processes are operated, the chemical compositions of the sulfur compounds and the hydrocarbon and caustic streams, as well as by the desired mercaptan conversion and other factors as will be recognized by those skilled in the art. Based on the improved results utilizing the nitrogen-based promoters, one skilled in the art will know how to adjust these parameters accordingly.

The foregoing discussion of this invention will be further exemplified by the following specific examples offered by way of illustration and not limitation of the above-described invention.

EXAMPLES

To evaluate the effectiveness of the nitrogen-based promoters of the present invention, a number of experiments were run. The experiments utilized a procedure called a "shake test" which is defined below. The specific test conditions are provided in each example.

The extraction effects of the nitrogen-based promoters were tested in Examples 1 and 2. In testing the extraction effects, a caustic solution was contacted with a series of hydrocarbon solutions having mercaptans and selected nitrogen-based promoters therein. Equilibrium constants, or Kq's, were measured to and compared with a base case, that is, a run made without the nitrogen-based promoter, to determine the effects of the promoters on the ability of the mercaptans to transfer from the hydrocarbon phase to the caustic phase.

The catalytic oxidation effects of the nitrogen-based promoters were tested in Examples 3 through 8. In testing the catalytic oxidation effects, a caustic solution having a mercaptan oxidation catalyst therein was contacted with a series of hydrocarbon solutions having mercaptans and selected nitrogen-based promoters therein. The mercaptan concentrations of the resulting hydrocarbon products were measured and compared with a base case to determine the effectiveness of the promoters on the oxidation reaction.

The color effects of the nitrogen-based promoters on selected of the resulting products were tested in Examples 9 and 10. Accelerated color tests were performed on the products and the Saybolt colors measured to determine any color changes caused by the use of the promoters.

The following terms are defined for the purposes of these Examples:

(a) "Shake test" refers to a simplified procedure utilized in determining the extraction and catalytic oxidation effects of the nitrogen-based promoters of this invention. The general "shake test" procedure is as follows, with the specific operating parameters defined in each Example:

(1) a sodium hydroxide solution of the desired concentration is prepared;
(2) the desired amount and type of mercaptan oxidation catalyst is added to the sodium hydroxide solution (for strict extraction tests, this step is omitted);
(3) 100 ml of a hydrocarbon is added to a 150 ml separatory funnel;
(4) the separatory funnel is placed in an oven and heated to the desired temperature;
(5) the desired amount and type of nitrogen-based promoter is added to the heated hydrocarbon (for the base cases, this step is omitted);
(6) the desired amount of sodium hydroxide solution (with or without oxidation catalyst) is added to the heated hydrocarbon;
(7) the contents of the separatory funnel are shaken for a desired time and allowed to settle for about 15 minutes; and
(8) samples of the hydrocarbon and sodium hydroxide phases are withdrawn and analyzed for mercaptan concentration in accordance with ASTM D3227-73.

As previously mentioned, the specific experimental conditions are given in each example, which may include omitting certain steps, most particularly steps 2 and 5.

(b) "Mixed Nitrogens" refers to a nitrogen stream produced as a by-product from the processing of coal tars. The exact composition of the stream is unknown and may vary, but it is comprised primarily of pyridine, indole, aniline, quinoline and isoquinoline based compounds.

(c) "Accelerated Color Tests" were conducted in accordance with ASTM D156-64.

(d) "Kq" refers to an equilibrium constant measured to determine the effects of the promoters on the ability of the mercaptans to transfer from the hydrocarbon phase to the caustic phase. "Kq" is calculated by dividing the concentration of mercaptan compounds in the caustic phase by the concentration of mercaptan compounds in the hydrocarbon phase.

EXAMPLE 1

A kerosene comprising approximately 950 ppm of mercaptans was contacted with a 20% NaOH solution at ambient temperature and pressure. The volumetric ratio of the hydrocarbon to NaOH solution was 5:1. No mercaptan oxidation catalyst was added. The two solutions were shaken for one minute, at which time the phases were separated and the mercaptan level in each phase measured.

As the results show, the addition of nitrogen-based promoters to the system significantly increased the mercaptan concentrations in the NaOH solution and, therefore, significantly increased the Kq values. This clearly indicates that the addition of the promoters has a significant positive effect on the extraction of mercaptan compounds from hydrocarbon streams.

TABLE I

| | Mercaptan Concentration (ppm) | | | | |
|---|---|---|---|---|---|
| Nitrogen Promoter | Feed | Product | Caustic | Kq's | Material Balance (%) |
| Base (No Promoter) | 950 | 849 | 389 | .46 | 98 |
| 5 ppm pyridine | 950 | 666 | 1513 | 2.3 | 102 |
| 5 ppm pyrimidine | 950 | 583 | 1737 | 3.0 | 98 |
| 5 ppm aniline | 950 | 687 | 1482 | 2.15 | 104 |
| 5 ppm quinoline | 950 | 693 | 1439 | 2.1 | 103 |
| 5 ppm melanine | 950 | 718 | 1043 | 1.5 | 98 |

EXAMPLE 2

A kerosene comprising approximately 1060 ppm of mercaptans was again contacted with a 20% NaOH solution at ambient temperature and pressure conditions. The volumetric ratio of the hydrocarbon to the NaOH solution was again 5:1, and no mercaptan oxidation catalyst was added. The two solutions were shaken for one minute, the phases were separated, then the mercaptan concentration in each phase measured. The results are presented in Table II.

As can be seen from the results, the addition of the nitrogen-based promoters again significantly increased the Kq values over the base case. One additional phenomena to be noted is that the use of larger amounts of the promoters may actually have less effect than the optimal smaller amounts. This is evidenced by the decreased Kq values when 10 ppm and 100 ppm of pyridine are added versus the additon of 5 ppm.

TABLE II

| | Mercaptan Concentration (ppm) | | | |
|---|---|---|---|---|
| Nitrogen Promoter | Feed | Product | Caustic | Kq's |
| Base (No Promoter) | 1060 | 949 | 463 | .49 |
| Pyridine (5 ppm) | 1060 | 666 | 1513 | 2.3 |
| Mixed (5 ppm) Nitrogens | 1060 | 671 | 1497 | 2.2 |
| Pyrimidine (5 ppm) | 1060 | 583 | 1737 | 3.0 |
| Pyridine (10 ppm) | 1060 | 660 | 1487 | 2.25 |
| Pyridine (100 ppm) | 1060 | 700 | 1282 | 1.83 |

EXAMPLE 3

A kerosene comprising approximately 950 ppm of mercaptans was contacted with a 20% NaOH solution having 200 ppm cobalt phthalocyanine catalyst therein in a series of one minute shake tests. The volumetric ratio of the kerosene to NaOH solution was 5:1, and the two were contacted in the presence of well over the stoichiometric amount of oxygen at a temperature of 150° F. and ambient pressure. The effect of the addition of each of a variety of nitrogen-based promoters to the above described system was tested.

The results of the tests are provided in Table III and clearly show improved mercaptan conversion. As can be seen, the use of the nitrogen-based promoters significantly reduced the mercaptan levels in the product streams. The results, therefore, provide a strong indication of the positive effects of using the nitrogen-based promoters in the practice of this invention.

TABLE III

| | Mercaptan Concentration (ppm) | | | | | |
|---|---|---|---|---|---|---|
| | One Minute | | Additional One Minute | | Additional One Minute | |
| Nitrogen Promoter | Feed | Product | Feed | Product | Feed | Product |
| Base (No Promoter) | 950 | 301 | 301 | 273 | — | — |
| Pyridine (5 ppm) | 950 | 190 | 190 | 70 | — | — |
| Pyrimidine (5 ppm) | 950 | 80 | 80 | 10 | — | — |
| Pyrimidine (1) (5 ppm) | 950 | 51 | 51 | 0 | — | — |
| Aniline (5 ppm) | 950 | 187 | 187 | 130 | — | — |
| Quinoline (5 ppm) | 950 | 191 | 191 | 122 | — | — |
| Melamine (5 ppm) | 950 | 273 | 273 | 199 | — | — |
| Mixed Nitrogens (5 ppm) | 950 | 125 | 125 | 98 | 98 | 87 |

(1) Temperature increased to 170° F.

EXAMPLE 4

A gasoline condensate stream from a gas well comprising approximately 118 ppm mercaptans was contacted with a 15% NaOH solution having 200 ppm cobalt phthalocyanine disulfonate catalyst therein in a series of one minute shake tests. The volumetric ratio of the gasoline to NaOH solution was 5:1, and the two were contacted in the presence of well over the stoichiometric amount of oxygen at a temperature of about 100° F. and at ambient pressure. The effect of the addition of each of a variety of nitrogen-based promoters to the above described system was tested.

The results of the tests are provided in Table IV. As can be seen, the results clearly show improved mercaptan conversion and provide a strong indication of the effectiveness of using the nitrogen-based promoters in the practice of this invention.

TABLE IV

| Nitrogen Promoter | Mercaptan Concentration (ppm) One Minute Feed | Product | NaOH | Additional One Minute Feed | Product | NaOH | Additional One Minute Feed | Product | NaOH |
|---|---|---|---|---|---|---|---|---|---|
| Base (No Promoter) | 118 | 30 | 0 | 30 | 19 | 0 | 19 | 18 | 0 |
| Aniline (5 ppm) | 118 | 8 | 0 | — | — | — | — | — | — |
| Pyridine (5 ppm) | 118 | 9 | 0 | — | — | — | — | — | — |

EXAMPLE 5

Another gasoline stream comprising approximately 290 ppm mercaptans was contacted with a 15% NaOH solution having 200 ppm cobalt phthalocyanine disulfonate catalyst therein in one minute standard shake tests. The volumetric ratio of the gasoline to the NaOH solution was 5:1, and the two were contacted in the presence of well over the stoichiometric amount of oxygen at a temperature of 100° F. and at ambient pressure. The effect of the addition of each of a variety of nitrogen-based promoters to the above described system was again tested.

The results of the tests are provided in Table V. As can again be seen, the results clearly show improved mercaptan conversion and provide a strong indication of the effectiveness of using the nitrogen-based promoters in the practice of this invention.

TABLE V

| Nitrogen Promoter | Mercaptan Concentration (ppm) Feed | Product | NaOH |
|---|---|---|---|
| Base (No Promoter) | 290 | 23 | 0 |
| Pyridine (5 ppm) | 290 | 0 | 0 |
| Aniline (5 ppm) | 290 | 0 | 0 |
| Pyrimidine (5 ppm) | 290 | 0 | 0 |
| Mixed Nitrogens (5 ppm) | 290 | 0 | 0 |

EXAMPLE 6

A gasoline having approximately 320 ppm of mercaptans therein was contacted with a 15% NaOH solution having 200 ppm cobalt phthalocyanine disulfonate catalyst therein in a series of thirty second and one minute standard shake tests. The volumetric ratio of the gasoline to NaOH solution was 5:1, and the two were contacted in the presence of well over the stoichiometric amount of oxygen at a temperature of 100° F. and ambient pressure. The effect of the addition of a variety of nitrogen-based promoters to the above described system was tested.

The results of the tests are provided in Table VI and clearly show the positive effects of adding the nitrogen-based promoters to the system.

TABLE VI

| Nitrogen Promoter | Mercaptan Concentration (ppm) Thirty Seconds Feed | Product | NaOH | Additional Thirty Seconds (1) Feed | Product | NaOH | One Minute Feed | Product | NaOH |
|---|---|---|---|---|---|---|---|---|---|
| Base (No Promoter) | 320 | 100 | 0 | 100 | 30 | 0 | — | — | — |
| Base (No Promoter) | — | — | — | — | — | — | 320 | 40 | 0 |
| Pyridine (5 ppm) | 320 | 66 | 0 | 66 | 19 | 0 | — | — | — |
| Pyridine (5 ppm) | — | — | — | — | — | — | 320 | 20 | 0 |
| Methenamine (5 ppm) | 320 | 54 | 0 | 54 | 9 | 0 | — | — | — |
| Methenamine (5 ppm) | — | — | — | — | — | — | 320 | 10 | 0 |

(1) Fresh NaOH solutions were used in the additional thirty second period.

EXAMPLE 7

A kerosene comprising approximately 1000 ppm of mercaptans was contacted with a 20% NaOH solution having 200 ppm cobalt phthalocyanine disulfonate catalyst therein in a series of one minute standard shake tests. The volumetric ratio of the kerosene to NaOH solution was 5:1, and the two were contacted in the presence of well over the stoichiometric amount of oxygen at a temperature of 150° F. and ambient pressure. The effects of the addition of 5 ppm of each of a wide variety of nitrogen-based promoters to the above described system was tested.

The results of the tests are provided in Table VII. As can be seen from the results, all of the listed nitrogen compounds enhance the conversion of the mercaptans over the base case without the promoter. After one minute, only 64% of the mercaptans in the base case were converted while anywhere from 80% to 93% of the mercaptans were converted utilizing the promoters. After two minutes, only 82% of the mercaptans in the base case were converted while anywhere from 84% to 99% of the mercaptans were converted utilizing the promoters. These results clearly indicate that the use of nitrogen-based promoters has positive effects on the processes utilized in the practice of this invention.

Those compounds found to be especially preferred include 1-phenylpyrrole, pyradazine, pyrimidine, methylpyrimidine, methenamine, 3-aminoquinoline, 5-triazolo[4,3-a]quioline, 4-azabenzimidazole, pyridopyrazine, 1,3,5 triazine, benzotriazole (Sandoz), pyrazine, 2-aminopyrimidine, 4-methyl piperidine, piperidine, azabicyclo[3,2,2]nonane, and 2,4 diaminotoluene.

TABLE VII

| Nitrogen Promoter | Mercaptan Concentration | | % Conversion | |
|---|---|---|---|---|
| | One Minute | Additional One Minute | One Minute | Additional One Minute |
| Base (No Promoter) | 360 | 180 | 64 | 82 |
| Pyridine | 192 | 130 | 81 | 87 |
| Picoline | 189 | 158 | 81 | 84 |
| Nicotinonitrile | 151 | 97 | 85 | 90 |
| 1-Phenyl Pyrrole | 107 | 47 | 89 | 95 |
| Phenazine | 110 | 60 | 89 | 94 |
| Pyradazine | 85 | 22 | 92 | 98 |
| Pyrimidine | 85 | 10 | 92 | 99 |
| 2,2 Bipyridine | 131 | 101 | 87 | 90 |
| Quinoline | 191 | 122 | 81 | 88 |
| Methyl Pyrimidine | 96 | 55 | 90 | 95 |
| Mixed Nitrogens | 125 | 100 | 88 | 90 |
| Methenamine | 91 | 44 | 91 | 96 |
| 3,4 Diamino Pyridine | 126 | 107 | 87 | 89 |
| Acridine | 118 | 74 | 88 | 93 |
| Quinaldine | 167 | 127 | 83 | 87 |
| N1N1-Dimethyl Benzylamine | 110 | 65 | 89 | 93 |
| Isoquinoline | 117 | 120 | 83 | 88 |
| 4-Aminopyrazolo [3,4-d] Pyrimidine | 131 | 85 | 87 | 92 |
| 3 Aminoquinoline | 97 | 38 | 90 | 96 |
| 7-Azaindole | 126 | 87 | 87 | 91 |
| S—Triazolo [4,3-a] Quinoline | 99 | 53 | 90 | 95 |
| 4-Azabenzimidazole | 87 | 29 | 91 | 97 |
| Pyrido Pyrazine | 98 | 33 | 90 | 97 |
| Amino Piperidine | 121 | 70 | 88 | 93 |
| 1,3,5 Triazine | 91 | 55 | 90 | 95 |
| L Histidine | 114 | 89 | 89 | 91 |
| 2,2 Biquinoline | 142 | 111 | 86 | 89 |
| Benzotriazole (Sandoz) | 83 | 42 | 92 | 96 |
| Quinoxaline | 115 | 101 | 88 | 90 |
| 1,2,4 Triazole | 125 | 92 | 87 | 91 |
| 5-Aminoindazole | 131 | 112 | 87 | 89 |
| Triethylene Diamine | 107 | 94 | 89 | 91 |
| Aminopyrazole | 177 | 149 | 82 | 85 |
| 5,10,15,20 Tetraphenyl-21H,23H Porphine | 100 | 75 | 90 | 93 |
| Pyrazine | 80 | 55 | 92 | 95 |
| Nicotine | 195 | 112 | 85 | 89 |
| 2-Anilinopyridine | 121 | 97 | 88 | 90 |
| 2-Aminopyrimidine | 91 | 30 | 91 | 97 |
| 4-Dimethyl Amino Pyridine | 106 | 86 | 89 | 91 |
| Benzimidazole (Archem) | 112 | 86 | 89 | 91 |
| N,Methyl Tolyimidazole (Archem) | 103 | 78 | 90 | 92 |
| Tolyimidazole (Archem) | 104 | 83 | 90 | 92 |
| Pyrrole | 203 | 158 | 80 | 84 |
| Pyrrolidine | 181 | 149 | 82 | 85 |
| 4 Methyl Piperidine | 111 | 50 | 89 | 95 |
| 2,5 Dimethyl Pyrrole | 191 | 157 | 81 | 84 |
| Piperidine | 73 | 42 | 93 | 96 |
| Piperazine | 123 | 68 | 88 | 93 |
| Pyrazole | 137 | 82 | 86 | 92 |
| Indole | 152 | 119 | 85 | 88 |
| 5 Methyl Indole | 197 | 149 | 80 | 85 |
| Indoline | 149 | 112 | 85 | 89 |
| Polyvinyl Piperidine | 163 | 128 | 84 | 87 |
| Skatole | 107 | 60 | 89 | 94 |
| Azabicyclo [3,2,2] Nonane | 103 | 44 | 90 | 96 |
| 4-Aminopyrene | 107 | 63 | 89 | 94 |
| Phthalocyanine | 140 | 119 | 86 | 88 |
| Homopiperazine | 117 | 87 | 88 | 91 |
| 1,4,8,12 Tetra-azacyclopentadecane | 110 | 93 | 89 | 91 |
| 5-Amino Indole | 112 | 84 | 89 | 92 |
| Carbazole | 110 | 80 | 89 | 92 |
| Aniline | 187 | 130 | 81 | 87 |
| 2,5 Dimethyl Aniline | 190 | 142 | 81 | 86 |
| 2,4 Diamino Toluene | 99 | 39 | 90 | 96 |
| Toluidine | 138 | 118 | 86 | 88 |
| Methylamine | 129 | 109 | 87 | 89 |
| Cycloxexylamine | 119 | 101 | 88 | 90 |
| Urea | 272 | 150 | 83 | 85 |
| T—Octylamine | 167 | 120 | 83 | 88 |

TABLE VII-continued

| Nitrogen Promoter | Mercaptan Concentration One Minute | Mercaptan Concentration Additional One Minute | % Conversion One Minute | % Conversion Additional One Minute |
|---|---|---|---|---|
| Octadecylamine | 146 | 100 | 85 | 90 |
| Ethylenediamine | 157 | 119 | 84 | 88 |
| L-Isoleucine | 102 | 71 | 90 | 93 |
| Triethylene Tetramine | 132 | 110 | 87 | 89 |
| Butylamine | 117 | 103 | 88 | 90 |
| Tolunitrile | 158 | 111 | 84 | 89 |
| Nitrobenzene | 129 | 115 | 87 | 88 |
| N—Heptylcyanide | 166 | 142 | 83 | 86 |

EXAMPLE 8

A kerosene comprising approximately 1000 ppm of mercaptans was contacted with a 20% NaOH solution having a varying amount of a carboxylated cobalt phthalocyanine catalyst therein in a series of one minute shake tests. The volumetric ratio of the kerosene to NaOH solution was 5:1, and the two were contacted in the presence of well over the stoichiometric amount of oxygen at a temperature of about 150° F. and at ambient pressure. The effect of utilizing various amounts of a carboxylated catalyst instead of the sulfonated catalyst was tested.

The results of the tests are provided in Table VIII. As can be seen, the nitrogen-based promoters enhance the conversion of the carboxylated catalyst at all concentrations. These results again show the effectiveness of using the nitrogen-based promoters in the practice of this invention.

TABLE VIX

| Hydrocarbon | Nitrogen Promoter | Saybolt Color Before Heat | Saybolt Color After Heat |
|---|---|---|---|
| Feed | None | +29 | 28 |
| Product | None | +29 | 28 |
| Product | Pyridine (5 ppm) | +29 | 28 |
| Product | Pyrimidine (5 ppm) | +29 | 28 |
| Product | Aniline (5 ppm) | +29 | 28 |
| Product | Quinoline (5 ppm) | +29 | 28 |

EXAMPLE 10

Another accelerated color test was run on the gasoline feed and some of the products from Example 6. The results, presented in Table X, indicate that the presence of the nitrogen-based promoter does have an effect on the color properties of the gasoline, as to be expected; however, the small amounts of nitrogen-based promoters used in Example 6 only cause a minimal decrease in the Saybolt Color, with the resulting color being well within the normal gasoline specification of 25.

TABLE VIII

| Catalyst Concentration (ppm) | Nitrogen Promoter | Mercapian Concentration (ppm) One Minute Product | One Minute NaOH | Additional One Minute Product | Additional One Minute NaOH | % Conversion One Minute | % Conversion Additional One Minute |
|---|---|---|---|---|---|---|---|
| 50 | Base (No Promoter) | 417 | 47 | 308 | 46 | 58 | 69 |
| 50 | Methenamine (5 ppm) | 160 | 33 | 90 | 35 | 83 | 91 |
| 50 | Mixed Nitrogen (5 ppm) | 177 | 34 | 143 | 37 | 82 | 86 |
| 100 | Base (No Promoter) | 411 | 32 | 308 | 39 | 59 | 69 |
| 100 | Methenamine (5 ppm) | 152 | 30 | 88 | 27 | 85 | 91 |
| 100 | Mixed Nitrogen (5 ppm) | 170 | 28 | 143 | 27 | 83 | 86 |
| 150 | Base (No Promoter) | 407 | 7 | 193 | 7 | 59 | 81 |
| 150 | Methenamine (5 ppm) | 150 | 6 | 81 | 8 | 85 | 92 |
| 150 | Mixed Nitrogen (5 ppm) | 163 | 10 | 140 | 5 | 84 | 86 |
| 200 | Base (No Promoter) | 406 | 6 | 193 | 7 | 59 | 81 |
| 200 | Methenamine (5 ppm) | 150 | 6 | 74 | 6 | 85 | 93 |
| 200 | Mixed Nitrogen | 160 | 9 | 137 | 7 | 84 | 86 |

EXAMPLE 9

An accelerated color test was run on the kerosene feed and several of the products from Example 3. The results, presented in Table IX, indicate that the presence of small amounts of the nitrogen-based promoters in the hydrocarbon product had little, if any, detrimental effect of the product color properties.

TABLE X

| Hydrocarbon | Nitrogen Promoter | Saybolt Color Before Heat | Saybolt Color After Heat |
|---|---|---|---|
| Feed | None | 30 | 28 |
| Product | None | 30 | 28 |
| Product | Pyridine (5 ppm) | 30 | 26 |
| Product | Methenamine (5 ppm) | 30 | 26 |

Those skilled in the art will be able to make variations of this invention from the foregoing descriptions and examples without departing from the scope and spirit of the claimed invention.

We claim:

1. An improved method of sweetening a sour hydrocarbon distillate having mercaptan compounds therein by the catalytic oxidation of said mercaptan compounds to disulfide compounds, wherein said distillate is contacted with a caustic solution, an oxidizing agent and a metal chelate mercaptan oxidation catalyst for a period of time sufficient to oxidize at least a portion of said mercaptan compounds to disulfide compounds, the improvement comprising contacting said distillate, said caustic solution, said oxidizing agent and said metal chelate mercaptan oxidation catalyst in the presence of from about 1 ppm to about 50 ppm by weight, based upon said distillate, of a nitrogen-based promoter, wherein said nitrogen-based promoter comprises a non-electrolytic, substantially sulfur free organic compound having at least one nitrogen atom, said nitrogen-based promoter being selected from the group consisting of:

heterocyclic compounds, wherein the ring or rings of said heterocyclic compounds consist of carbon and nitrogen atoms, said heterocyclic compounds being selected from the group consisting of pyridine, picolene, nicotinonitrile, 1-phenylpyrrole, 2,2-bipyridine, quinoline, 2,2-biquinoline, triazine, melamine, methenamine, 3,4-diaminopyridine, 3-aminopyridine, acridine, quinaldine, isoquinoline, 3-aminoquinoline, 7-azaindole, 5-triazolo[4,3-a]quinoline, 4-azabenzimidazole, L-histidine, aminopiperidine, benzotriazole, 1,2,4-triazole, 5-aminoindazole, aminopyrazole, 5,10,15,20-tetraphenyl 21H,23H porphine, nicotine, 2-analinopyridine, 4-dimethylaminopyridine, benzimidazole, N-methyltolyimidazole, tolyimidazole, pyrrole, pyrrolidine, 4-methylpiperidine, 2,5 dimethylpyrrole, piperidine, 1-ethylpiperidine, 2-ethylpiperidine, pyrazole, indole, 3-methylindole, 5-methylindole, indoline, polyvinyl piperidine, azabicyclo[3,2,2]nonane, phthalocyanine, 1,4,8,12 tetraazacyclopentadicane, 5-aminoindole, carbazole, imidazole, N-alkylate imidazole, skatole, quinalidine, 2,3-cyclopentenepyridine and penanthroline;

substituted homocyclic compounds, wherein at least one substituent attached to the ring or rings of said homocyclic compounds comprises at least one nitrogen atom;

aliphatic compounds comprising at least one nitrogen atom; and mixtures thereof.

2. The improved method of claim 1, wherein said homocyclic compounds further comprise from about 3 to about 34 atoms in the ring or rings thereof.

3. The improved method of claim 1, wherein said distillate is contacted with said caustic solution, said oxidizing agent and said mercaptan oxidation catalyst in the presence of from about 1 ppm to about 10 ppm by weight based upon said distillate, of said nitrogen-based promoter.

4. The improved method of claim 3, wherein said distillate is contacted with said caustic solution, said oxidizing agent and said mercaptan oxidation catalyst in the presence of from about 4 to about 6 ppm by weight, based upon said distillate, of said nitrogen-based promoter.

5. The improved method of claim 1, wherein said metal chelate comprises a metal phthalocyanine or derivative thereof.

6. The improved method of claim 1, wherein said distillate is contacted with said caustic solution, said oxidizing agent and said mercaptan oxidation catalyst in the presence of said nitrogen-based promoters and further in the presence of a fiber bundle, a fixed bed having said mercaptan oxidation catalyst therein, or both.

7. An improved method of sweetening a sour hydrocarbon distillate having mercaptan compounds therein by the extraction of said mercaptan compounds from said distillate, wherein said distillate is contacted with a caustic solution for a period of time sufficient to extract at least a portion of said mercaptan compounds into said caustic solution, the improvement comprising contacting said distillate and said caustic solution in the presence of from about 1 ppm to about 50 ppm by weight, based upon said distillate, of a nitrogen-based promoter, wherein said nitrogen-based promoter comprises a non-electrolytic, substantially sulfur free organic compound having at least one nitrogen atom, said nitrogen-based promoter being selected from the group consisting of:

heterocyclic compounds, wherein the ring or rings of said heterocyclic compounds consist of carbon and nitrogen atoms, said heterocyclic compounds being selected from the group consisting of pyridine, picolene, nicotinonitrile, 1-phenylpyrrole, 2,2-bipyridine, quinoline, 2,2-biquinoline, triazine, melamine, methenamine, 3,4-diaminopyridine, 3-aminopyridine, acridine, quinaldine, isoquinoline, 3-aminoquinoline, 7-azaindole, 5-triazolo[4,3-a]quinoline, 4-azabenzimidazole, L-histidine, aminopiperidine, benzotriazole, 1,2,4-triazole, 5-aminoindazole, aminopyrazole, 5,10,15,20-tetraphenyl 21H,23H porphine, nicotine, 2-analinopyridine, 4-dimethylaminopyridine, benzimidazole, N-methyltolyimidazole, tolyimidazole, pyrrole, pyrrolidine, 4-methylpiperidine, 2,5 dimethylpyrrole, piperidine, 1-ethylpiperidine, 2-ethylpiperidine, pyrazole, indole, 3-methylindole, 5-methylindole, indoline, polyvinyl piperidine, azabicyclo[3,2,2]nonane, phthalocyanine, 1,4,8,12 tetraazacyclopentadicane, 5-aminoindole, carbazole, imidazole, N-alkylate imidazole, skatole, quinalidine, 2,3-cyclopentenepyridine and penanthroline;

substituted homocyclic compounds, wherein at least one substituent attached to the ring or rings of said homocyclic compounds comprises at least one nitrogen atom;

aliphatic compounds comprising at least one nitrogen atom; and mixtures thereof.

8. The improved method of claim 7, wherein said homocyclic compounds further comprise from about 3 to about 34 atoms in the ring or rings thereof.

9. The improved method of claim 7, wherein said distillate and said caustic solution are contacted in the presence of from about 1 ppm to about 10 ppm by weight, based upon said distillate, of said nitrogen-based promoter.

10. The improved method of claim 9, wherein said distillate and said caustic solution are contacted in the presence of from about 4 to about 6 ppm by weight, based upon said distillate, of said nitrogen-based promoter.

11. An improved method for regenerating a spent caustic stream having mercaptide compounds therein by the catalytic oxidation of said mercaptide compounds to disulfide compounds and extraction thereof from said caustic solution, wherein said spent caustic solution is contacted with a hydrocarbon distillate in the presence of an oxidizing agent and a metal chelate mercaptan oxidation catalyst for a period of time sufficient to oxidize at least a portion of said mercaptide compounds to disulfide compounds and to extract at least a portion of said disulfide compounds into said hydrocarbon distillate, the improvement comprising contacting said distillate and caustic stream in the presence of said oxidizing agent and said metal chelate mercaptan oxidation catalyst and also in the presence of from about 1 ppm to about 50 ppm by weight, based upon said distillate, of a nitrogen-based promoter, comprising a non-electrolytic, substantially sulfur free organic compound having at least one nitrogen atom, said nitrogen-based promoter being selected from the group consisting of:

heterocyclic compounds, wherein the ring or rings of said heterocyclic compounds consist of carbon and nitrogen atoms, said heterocyclic compounds being selected from the group consisting of pyridine, picolene, nicotinonitrile, 1-phenylpyrrole, 2,2-bipyridine, quinoline, 2,2-biquinoline, triazine, melamine, methenamine, 3,4-diaminopyridine, 3-aminopyridine, acridine, quinaldine, isoquinoline, 3-aminoquinoline, 7-azaindole, 5-triazolo[4,3-a]quinoline, 4-azabenzimidazole, L-histidine, aminopiperidine, benzotriazole, 1,2,4-triazole, 5-aminoindazole, aminopyrazole, 5,10,15,20-tetraphenyl 21H,23H porphine, nicotine, 2-analinopyridine, 4-dimethylaminopyridine, benzimidazole, N-methyltolyimidazole, tolyimidazole, pyrrole, pyrrolidine, 4-methylpiperidine, 2,5 dimethylpyrrole, piperidine, 1-ethylpiperidine, 2-ethylpiperidine, pyrazole, indole, 3-methylindole, 5-methylindole, indoline, polyvinyl piperidine, azabicyclo[3,2,2]nonane, phthalocyanine, 1,4,8,12 tetraazacyclopentadicane, 5-aminoindole, carbazole, imidazole, N-alkylate imidazole, skatole, quinalidine, 2,3-cyclopentenepyridine and penanthroline;

substituted homocyclic compounds, wherein at least one substituent attached to the ring or rings of said homocyclic compounds comprises at least one nitrogen atom;

aliphatic compounds comprising at least one nitrogen atom; and mixtures thereof.

12. The improved method of claim 11, said homocyclic compounds further comprise from about 3 to about 34 atoms in the ring or rings thereof.

13. The improved method of claim 11, wherein said metal chelate comprises a metal phthalocyanine or derivative thereof.

14. The improved method of claim 11, wherein said distillate and said caustic solution are contacted in the presence of said oxidizing agent, said mercaptan oxidation catalyst and from about 1 ppm to about 10 ppm by weight, based upon said distillate, of said nitrogen-based promoter.

15. The improved method of claim 14, wherein said distillate and said caustic solution are contacted in the presence of said oxidizing agent, said mercaptan oxidation catalyst and from about 4 to about 6 ppm by weight, based upon said distillate, of said nitrogen-based promoter.

16. A method of regenerating a caustic stream or sweetening a hydrocarbon stream having mercaptan or mercaptan-based compounds therein, comprising the steps of:

introducing said caustic stream onto the upstream end of a fiber bundle positioned within a conduit, wherein the downstream end of said fiber bundle extends out of said conduit into a collection vessel;

flowing said hydrocarbon stream cocurrently through said conduit in contact with said caustic stream in the presence of from about 1 ppm to about 50 ppm by weight, based upon said hydrocarbon stream, of a nitrogen-based promoter, wherein said nitrogen-based promoter comprises a non-electrolytic, substantially sulfur free organic compound having at least one nitrogen atom, said nitrogen-based promoter being selected from the group consisting of:

heterocyclic compounds wherein the ring or rings of said heterocyclic compounds consist of carbon and nitrogen atoms, said heterocyclic compounds being selected from the group consisting of pyridine, picolene, nicotinonitrile, 1-phenylpyrrole, 2,2-bipyridine, quinoline, 2,2-biquinoline, triazine, melamine, methenamine, 3,4-diaminopyridine, 3-aminopyridine, acridine, quinaldine, isoquinoline, 3-aminoquinoline, 7-azaindole, 5-triazolo [4,3-a] quinoline, 4-azabenzimidazole, L-histidine, aminopiperidine, 2,2'-biquinoline, benzotriazole, 1,2,4-triazole, 5-aminoindazole, aminopyrazole, 5,10,15,20-tetraphenyl 21H,23H porphine, nicotine, 2-analinopyridine, 4-dimethylaminopyridine, benzimidazole, N-methyltolyimidazole, tolyimidazole, pyrrole, pyrrolidine, 4-methylpiperidine, 2,5 dimethylpyrrole, piperidine, 1-ethylpiperidine, 2-ethylpiperidine, pyrazole, indole, 3-methylindole, 5-methylindole, indoline, polyvinyl piperidine, azabicyclo [3,2,2] nonane, phthalocyanine, 1,4,8,12 tetraazacyclopentadicane, 5-aminoindole, carbazole, imidazole, N-alkylate imidazole, skatole, quinalidine, 2,3-cyclopentenepyridine and penanthroline, substituted homocyclic compounds wherein at least one substituent attached to the ring or rings of said homocyclic compounds comprises at least one nitrogen atom, aliphatic compounds comprising at least one nitrogen atom, and mixtures thereof;

receiving said hydrocarbon stream and said caustic stream in said collection vessel, wherein said hydrocarbon stream forms an upper layer in said collection vessel, and wherein said caustic stream forms a lower layer in said collection vessel;

withdrawing said hydrocarbon stream from said collection vessel; and withdrawing said caustic stream from said collection vessel.

17. The method of claim 16, wherein said homocyclic compounds further comprise from about 3 to about 34 atoms in the ring or rings thereof.

18. The method of claim 11, wherein said hydrocarbon stream and said caustic stream are contacted in the presence of from about 1 ppm to about 10 ppm by weight, based upon said hydrocarbon stream, of said nitrogen-based promoter.

19. The method of claim 18, wherein said hydrocarbon stream and said caustic stream are contacted in the presence of from about 4 to about 6 ppm by weight, based upon said hydrocarbon stream, of said nitrogen-based promoter.

20. The method of claim 16, wherein said sour hydrocarbon stream and said caustic stream are contacted in the presence of said nitrogen-based promoter for a time sufficient to extract at least a portion of said mercaptan compounds into said caustic stream.

21. The method of claim 16, wherein said sour hydrocarbon stream and said caustic stream are contacted in the presence of said nitrogen-based promoter and further in the presence of an oxidizing agent and a metal chelate mercaptan oxidation catalyst for a time sufficient to oxidize at least a portion of said mercaptan compounds to disulfide compounds.

22. The method of claim 13, wherein said metal chelate comprises a metal phthalocyanine or derivative thereof.

23. The method of claim 16, wherein said spent caustic stream and said hydrocarbon stream are contacted in the presence of said nitrogen-based promoter and further in the presence of an oxidizing agent and a metal chelate mercaptan oxidation catalyst for a time sufficient to oxidize at least a portion of said mercaptide compounds to disulfide compounds and to extract at least a portion of said disulfide compounds into said hydrocarbon stream.

24. The method of claim 23, wherein said metal chelate comprises a metal phthalocyanine or derivative thereof.

25. A method of regenerating a caustic stream or sweetening a hydrocarbon stream having mercaptan or mercaptan-based compounds therein, comprising the steps of:

introducing said caustic stream onto an upstream end of a fiber bundle positioned within a conduit, wherein said fiber bundle has a downstream end extending from said conduit into a collection vessel having an upper and lower portion;

introducing into the upper portion of said collection vessel said hydrocarbon stream at a sufficient rate and pressure to flow said hydrocarbon stream countercurrently through said conduit, in contact with said caustic stream in the presence of from about 1 ppm to about 50 ppm by weight, based upon said hydrocarbon stream, of a nitrogen-based promoter, wherein said nitrogen-based promoter comprises a non-electrolytic, substantially sulfur free organic compound having at least one nitrogen atom, selected from the group consisting of:

heterocyclic compounds wherein the ring or rings of said heterocyclic compounds consist of carbon and nitrogen atoms, said heterocyclic compounds being selected from the group consisting of pyridine, picolene, nicotinonitrile, 1-phenylpyrrole, 2,2-bipyridine, quinoline, 2,2-biquinoline, triazine, melamine, methenamine, 3,4-diaminopyridine, 3-aminopyridine, acridine, quinaldine, isoquinoline, 3-aminoquinoline, 7-azaindole, 5-triazolo [4,3-a] quinoline, 4-azabenzimidazole, L-histidine, aminopiperidine, benzotriazole, 1,2,4-triazole, 5-aminoindazole, aminopyrazole, 5,10,15,20-tetraphenyl 21H,23H porphine, nicotine, 2-analinopyridine, 4-dimethylaminopyridine, benzimidazole, N-methyltolyimidazole, tolyimidazole, pyrrole, pyrrolidine, 4-methylpiperidine, 2,5 dimethylpyrrole, piperidine, 1-ethylpiperidine, 2-ethylpiperidine, pyrazole, indole, 3-methylindole, 5-methylindole, indoline, polyvinyl piperidine, azabicyclo [3,2,2] nonane, phthalocyanine, 1,4,8,12 tetraazacyclopentadicane, 5-aminoindole, carbazole, imidazole, N-alkylate imidazole, skatole, quinalidine, 2,3-cyclopentenepyridine and penanthroline, substituted homocyclic compounds wherein at least one substituent attached to the ring or rings of said homocyclic compounds comprises at least one nitrogen atom, aliphatic compounds comprising at least one nitrogen atom and mixtures thereof;

receiving a first portion of said caustic stream and a first portion of said hydrocarbon stream in said collection vessel, wherein said hydrocarbon stream forms an upper layer in said collection vessel and said caustic stream forms a lower layer in said collection vessel, and wherein said caustic stream is withdrawn from said lower portion of said collection vessel;

withdrawing a second portion of said hydrocarbon stream and a second portion of said caustic stream after contact with said upstream end of said fiber bundle; and receiving in a separator said second portion of said hydrocarbon stream and said second portion of said caustic stream, wherein said hydrocarbon stream forms an upper layer and said caustic stream forms a lower layer in said separator, and wherein said hydrocarbon stream and said caustic stream are withdrawn from said separator.

26. The method of claim 25, wherein said homocyclic compounds further comprise from about 3 to about 34 atoms in the ring or rings thereof.

27. The method of claim 25, wherein said hydrocarbon stream and said caustic solution are contacted in the presence of from about 1 ppm to about 10 ppm by weight, based upon said hydrocarbon stream, of said nitrogen-based promoter.

28. The method of claim 27, wherein said hydrocarbon stream and said caustic solution are contacted in the presence of from about 4 to about 6 ppm by weight, based upon said hydrocarbon stream, of said nitrogen-based promoter.

29. The method of claim 25, wherein said sour hydrocarbon stream and said caustic stream are contacted in the presence of said nitrogen-based promoter for a time sufficient to extract at least a portion of said mercaptan compounds into said caustic stream.

30. The method of claim 25, wherein said sour hydrocarbon stream and said caustic stream are contacted in the presence of said nitrogen-based promoter and further in the presence of an oxidizing agent and a metal chelate mercaptan oxidation catalyst for a time sufficient to oxidize at least a portion of said mercaptan compounds to disulfide compounds.

31. The method of claim 30, wherein said metal chelate comprises a metal phthalocyanine or derivative thereof.

32. The method of claim 25, wherein said spent caustic stream and said hydrocarbon stream are contacted in the presence of said nitrogen-based promoter and further in the presence of an oxidizing agent and a metal chelate mercaptan oxidation catalyst for a time sufficient to oxidize at least a portion of said mercaptide compounds to disulfide compounds and to extract at least a portion of said disulfide compounds into said hydrocarbon stream.

33. The method of claim 32, wherein said metal chelate comprises a metal phthalocyanine or derivative thereof.

34. A method of sweetening sour hydrocarbon distillate having mercaptan compounds therein by the catalytic oxidation of said mercaptan compounds to disulfide compounds, comprising the steps of:

contacting said hydrocarbon distillate with a caustic stream in the presence of a fixed bed carrying a metal chelate mercaptan oxidation catalyst and further in the presence of an oxidizing agent and from about 1 ppm to about 50 ppm by weight, based upon said hydrocarbon stream, of a nitrogen-based promoter for a time sufficient to oxidize at least a portion of said mercaptan compounds to disulfide compounds, wherein said nitrogen-based promoter comprises a non-electrolytic, substantially sulfur free organic compound having at least one nitrogen atom, selected from the group consisting of:

heterocyclic compounds wherein the ring or rings of said heterocyclic compounds consist of carbon and nitrogen atoms, said heterocyclic compounds being selected from the group consisting of pyridine, picolene, nicotinonitrile, 1-phenylpyrrole, 2,2-bipyridine, quinoline, 2,2-biquinoline, triazine, melamine, methenamine, 3,4-diaminopyridine, 3-aminopyridine, acridine, quinaldine, isoquinoline, 3-aminoquinoline, 7-azaindole, 5-triazolo[4,3-a]quinoline, 4-azabenzimidazole, L-histidine, aminopiperidine, benzotriazole, 1,2,4-triazole, 5-aminoindazole, aminopyrazole, 5,10,15,20-tetraphenyl 21H,23H porphine, nicotine, 2-analinopyridine, 4-dimethylaminopyridine, benzimidazole, N-methyltolyimidazole, tolyimidazole, pyrrole, pyrrolidine, 4-methylpiperidine, 2,5 dimethylpyrrole, piperidine, 1-ethylpiperidine, 2-ethylpiperidine, pyrazole, indole, 3-methylindole, 5-methylindole, indoline, polyvinyl piperidine, azabicyclo[3,2,2]nonane, phthalocyanine, 1,4,8,12 tetraazacyclopentadicane, 5-aminoindole, carbazole, imidazole, N-alkylate imidazole, skatole, quinalidine, 2,3-cyclopentenepyridine and penanthroline, substituted homocyclic compounds wherein at least one substituent attached to the ring or rings of said homocyclic compounds comprises at least one nitrogen atom, aliphatic compounds comprising at least one nitrogen atom, and mixtures thereof;

receiving said hydrocarbon stream and said caustic stream in a collection vessel, wherein said hydrocarbon stream forms an upper layer in said collection vessel, and wherein said caustic stream forms a lower layer in said collection vessel;

withdrawing said hydrocarbon stream from said collection vessel; and withdrawing said caustic stream from said collection vessel.

35. The method of claim 34, wherein said homocyclic compounds further comprise from about 3 to about 34 atoms in the ring or rings thereof.

36. The method of claim 34, wherein said distillate and said caustic solution are contacted in the presence of from about 1 ppm to about 10 ppm by weight, based upon said hydrocarbon distillate, of said nitrogen-based promoter.

37. The method of claim 36, wherein said distillate and said caustic solution are contacted in the presence of from about 4 to about 6 ppm by weight, based upon said hydrocarbon distillate, of said nitrogen-based promoter.

38. The method of claim 34, wherein said metal chelate comprises a metal phthalocyanine or derivative thereof.

39. A method of sweetening a sour hydrocarbon distillate having mercaptan compounds therein by the catalytic oxidation of said mercaptan compounds to disulfide compounds, comprising the steps of:

introducing a first caustic stream onto an upstream end of a fiber bundle positioned within a conduit, wherein the downstream end of said fiber bundle extends out of said conduit into a collection vessel;

flowing said hydrocarbon distillate through said conduit, in contact with said first caustic stream in the presence of an oxidizing agent, a metal chelate mercaptan oxidation catalyst, and from about 1 ppm to about 50 ppm by weight, based upon said hydrocarbon distillate, of a nitrogen-based promoter for a time sufficient to oxidize at least a portion of said mercaptan compounds to disulfide compounds, wherein said nitrogen-based promoter comprises a non-electrolytic, substantially sulfur free organic compound having at least one nitrogen atom, selected from the group consisting of:

heterocyclic compounds wherein the ring or rings of said heterocyclic compounds consist of carbon and nitrogen atoms, said heterocyclic compounds being selected from the group consisting of pyridine, picolene, nicotinonitrile, 1-phenylpyrrole, 2,2-bipyridine, quinoline, 2,2-biquinoline, triazine, melamine, methenamine, 3,4-diaminopyridine, 3-aminopyridine, acridine, quinaldine, isoquinoline, 3-aminoquinoline, 7-azaindole, 5-triazolo,[4,3-a] quinoline, 4-azabenzimidazole, L-histidine, aminopiperidine, benzotriazole, 1,2,4-triazole, 5-aminoindazole, aminopyrazole, 5,10,15,20-tetraphenyl 21H,23H porphine, nicotine, 2-analinopyridine, 4-dimethylaminopyridine, benzimidazole, N-methyltolyimidazole, tolyimidazole, pyrrole, pyrrolidine, 4-methylpiperidine, 2,5 dimethylpyrrole, piperidine, 1-ethylpiperidine, 2-ethylpiperidine, pyrazole, indole, 3-methylindole, 5-methylindole, indoline, polyvinyl piperidine, azabicyclo[3,2,2]nonane, phthalocyanine, 1,4,8,12 tetraazacyclopentadicane, 5-aminoindole, carbazole, imidazole, N-alkylate imidazole, skatole, quinalidine, 2,3-cyclopentenepyridine and penanthroline, substituted homocyclic compounds wherein at least one substituent attached to the ring or rings of said homocyclic compounds comprises at least one nitrogen atom, aliphatic compounds comprising at least one nitrogen atom, and mixtures thereof;

receiving said hydrocarbon distillate and said first caustic stream in said collection vessel; and further contacting said hydrocarbon distillate with a second caustic stream in the presence of said oxidizing agent and nitrogen-based promoter and further in the presence of a fixed bed catalyst for a time sufficient to oxidize a portion of the remaining mercaptan compounds to disulfide compounds, wherein said fixed bed catalyst comprises a supported metal chelate mercaptan oxidation catalyst.

40. The method of claim 39, wherein said homocyclic compounds further comprise from about 3 to about 34 atoms in the ring or rings thereof.

41. The method of claim 39, wherein said distillate and said caustic solution are contacted in the presence of from about 1 ppm to about 10 ppm by weight, based upon said distillate, of said nitrogen-based promoter.

42. The method of claim 41, wherein said distillate and said caustic solution are contacted in the presence of from about 4 to about 6 ppm by weight, based upon said distillate, of said nitrogen-based promoter.

43. The method of claim 39, wherein said metal chelate comprises a metal phthalocyanine or derivative thereof.

44. The improved method of claim 2, wherein said nitrogen-based promoters are selected from the group consisting of 1-phenylpyrrole, methenamine, 3-aminoquinoline, s-triazolo[4,3-a]quinoline, 4-azabenzimidazole, 1,3,5-triazine, benzotriazole, 4-methylpiperidine, piperidine, azabicyclo[3,2,2]nonane, 2,4-diaminotoluene and mixtures thereof.

45. The improved method of claim 8, wherein said nitrogen-based promoters are selected from the group consisting of 1-phenylpyrrole, methenamine, 3-aminoquinoline, s-triazolo[4,3-a]quinoline, 4-azabenzimidazole, 1,3,5-triazine, benzotriazole, 4-methylpiperidine, piperidine, azabicyclo[3,2,2]nonane, 2,4-diaminotoluene and mixtures thereof.

46. The improved method of claim 12, wherein said nitrogen-based promoters are selected from the group consisting of 1-phenylpyrrole, methenamine, 3-aminoquinoline, s-triazolo[4,3-a]quinoline, 4-azabenzimidazole, 1,3,5-triazine, benzotriazole, 4-methylpiperidine, piperidine, azabicyclo[3,2,2]nonane, 2,4-diaminotoluene and mixtures thereof.

47. The method of claim 17, wherein said nitrogen-based promoters are selected from the group consisting of 1-phenylpyrrole, methenamine, 3-aminoquinoline, s-triazolo[4,3-a]quinoline, 4-azabenzimidazole, 1,3,5-triazine, benzotriazole, 4-methylpiperidine, piperidine, azabicyclo[3,2,2]nonane, 2,4-diaminotoluene and mixtures thereof.

48. The method of claim 26, wherein said nitrogen-based promoters are selected from the group consisting of 1-phenylpyrrole, methenamine, 3-aminoquinoline, s-triazolo[4,3-a]quinoline, 4-azabenzimidazole, 1,3,5-triazine, benzotriazole, 4-methylpiperidine, piperidine, azabicyclo[3,2,2]nonane, 2,4-diaminotoluene and mixtures thereof.

49. The method of claim 35, wherein said nitrogen-based promoters are selected from the group consisting of 1-phenylpyrrole, methenamine, 3-aminoquinoline, s-triazolo[4,3-a]quinoline, 4-azabenzimidazole, 1,3,5-triazine, benzotriazole, 4-methylpiperidine, piperidine, azabicyclo[3,2,2]nonane, 2,4-diaminotoluene and mixtures thereof.

50. The method of claim 40, wherein said nitrogen-based promoters are selected from the group consisting of 1-phenylpyrrole, methenamine, 3-aminoquinoline, s-triazolo[4,3-a]quinoline, 4-azabenzimidazole, 1,3,5-triazine, benzotriazole, 4-methylpiperidine, piperidine, azabicyclo[3,2,2]nonane, 2,4-diaminotoluene and mixtures thereof.

* * * * *